US008857927B2

(12) United States Patent
Johnson et al.

(10) Patent No.: US 8,857,927 B2
(45) Date of Patent: Oct. 14, 2014

(54) DRAWER INSERT FOR FILE CABINET

(75) Inventors: Ross Johnson, Jenison, MI (US); Harold R. Wilson, Holland, MI (US)

(73) Assignee: Haworth, Inc., Holland, MI (US)

( * ) Notice: Subject to any disclaimer, the term of this patent is extended or adjusted under 35 U.S.C. 154(b) by 267 days.

(21) Appl. No.: 13/343,122

(22) Filed: Jan. 4, 2012

(65) Prior Publication Data

US 2013/0169132 A1 Jul. 4, 2013

(51) Int. Cl.
*A47B 88/00* (2006.01)
*A47B 95/00* (2006.01)

(52) U.S. Cl.
USPC ..... 312/301

(58) Field of Classification Search
CPC ..... A47B 88/02
USPC ..... 312/246, 270.1, 270.3, 291, 298, 301, 312/331, 332.1, 333, 215, 222, 402, 404, 312/334.7
See application file for complete search history.

(56) References Cited

U.S. PATENT DOCUMENTS

| | | | | |
|---|---|---|---|---|
| 1,061,646 | A | 5/1913 | Welliver | |
| 1,993,477 | A * | 3/1935 | Gourley et al. | 312/301 |
| 2,000,981 | A * | 5/1935 | Parsons | 312/228 |
| 2,711,944 | A * | 6/1955 | Meek et al. | 312/333 |
| 3,339,994 | A * | 9/1967 | Reddig et al. | 312/301 |
| 4,993,786 | A | 2/1991 | DeGiulio | |
| 5,044,059 | A * | 9/1991 | De Giulio | 29/401.1 |
| 5,088,801 | A | 2/1992 | Rorke et al. | |
| 5,105,953 | A * | 4/1992 | Finnegan | 211/183 |
| 5,211,461 | A | 5/1993 | Teufel et al. | |
| 5,299,863 | A * | 4/1994 | Albright, Jr. | 312/404 |
| 5,322,365 | A | 6/1994 | Teufel et al. | |
| 5,586,816 | A * | 12/1996 | Geiss, II | 312/301 |
| 5,761,786 | A | 6/1998 | Simons | |
| 5,927,839 | A * | 7/1999 | Alfaro | 312/301 |
| 6,158,103 | A | 12/2000 | Grubb | |
| 6,402,271 | B1 * | 6/2002 | Kelley et al. | 312/196 |
| 7,168,773 | B1 | 1/2007 | Emary | |
| 7,216,412 | B2 | 5/2007 | Vance | |
| 7,275,797 | B2 | 10/2007 | Timmermann et al. | |
| 8,210,625 | B2 * | 7/2012 | Rotter et al. | 312/402 |
| 8,424,983 | B1 * | 4/2013 | Strauss et al. | 312/247 |
| 8,641,156 | B2 * | 2/2014 | Chow | 312/247 |
| 8,708,435 | B2 * | 4/2014 | Johnson et al. | 312/330.1 |
| 2010/0219727 | A1 * | 9/2010 | Aguilar Ante et al. | 312/319.1 |

FOREIGN PATENT DOCUMENTS

EP 0306701 A2 3/1989

* cited by examiner

*Primary Examiner* — Matthew Ing
*Assistant Examiner* — Andres F Gallego
(74) *Attorney, Agent, or Firm* — Warner Norcross & Judd LLP

(57) ABSTRACT

An insert for an existing file drawer. The insert includes upper and lower insert drawers which are each of shallower depth and fit within the original drawer compartment in a vertically stacked relationship. The upper and lower insert drawers are coupled between the original drawer front and the remaining original box structure. The insert drawers are horizontally slidably mounted one above the other so that opening movement of the drawer front horizontally sequentially extends the upper and lower insert drawers into a fully open position which enables access into both insert drawers.

22 Claims, 26 Drawing Sheets

DRAWER INSERT FOR FILE CABINET

FIELD OF THE INVENTION

This invention relates to a drawer arrangement for a cabinet structure and, more specifically, to an improved drawer insert which can be fitted to an existing original drawer for cooperation between the existing original drawer box and the existing original drawer front for converting a single drawer into two shallow drawers which are telescopically movable between a stacked position wherein the two insert drawers are disposed vertically one above the other and a horizontally extended position wherein the two drawers are horizontally offset so as to both be vertically accessible.

BACKGROUND OF THE INVENTION

Cabinet structures employing one or more horizontally-openable drawers are extensively utilized in offices and similar environments for storage of files, miscellaneous papers, and miscellaneous other objects. Such cabinet structures, including those referred to as "lateral files", generally provide a plurality of horizontally-openable drawers which individually have an upwardly-opening box-shaped structure defining a storage compartment. In many instances the box-shaped drawers are fairly deep, particularly those which are designed for storage of files and similar papers. However, the storage demands of a user may vary over time, and the user's storage needs may be such as to require fewer deep-compartment drawers since the articles being stored may be more suitable for shallow drawers. While various adaptor structures are available for disposition within the drawer to create various storage levels or compartments, such adaptors typically do not permit convenient access to articles stored below the adaptor without requiring entire removal of the adaptor, or in the alternative the adaptor is not effective for providing storage and/or access to the entire horizontal interior of the compartment over multiple levels.

Accordingly, it is an object of this invention to provide an improved insert for an existing drawer, which insert includes upper and lower insert drawers which are each of shallower depth and fit within the original drawer compartment in a generally vertically stacked relationship, which upper and lower insert drawers are coupled between the original drawer front and the remaining original box structure, in which the insert drawers are horizontally slidably mounted one above the other so that full opening movement of the drawer front horizontally extends the upper and lower insert drawers into a fully open position which simultaneously enables vertical access into the up-facing compartments of both the upper and lower insert drawers.

It is a further object of the invention, as aforesaid, to provide a drawer insert which can be easily retrofitted to an existing cabinet drawer and which involves a simple demounting of the original drawer front from the remainder of the original drawer box structure, with the lower insert drawer being mounted to the drawer front and horizontally slidably coupled to the upper insert drawer, the latter in turn being coupled to end walls of the original box structure, thereby enabling a simple conversion of the original deep drawer to a pair of shallow insert drawers which are vertically positioned above one another when the original drawer front is in closed engagement with the cabinet, but which enables the upper and lower insert drawers to be horizontally displaced from the cabinet by suitable opening movement of the original drawer front into a first position wherein both insert drawers are horizontally displaced so that the upper drawer is accessible, and then into a second horizontally opened position wherein the drawer front is displaced horizontally further from the cabinet so that only the lower insert drawer is displaced horizontally so that both drawers are simultaneously vertically accessible.

It is a still further object of the invention, as aforesaid, to provide a drawer insert which enables conversion of a standard existing drawer requiring few if any tools, primarily only whatever tools are required to disassemble the original drawer front from the original drawer box structure, with the drawer insert being assembled and coupled between the original drawer front and the remaining end walls of the box structure without requiring specific tools or threaded fasteners.

In accordance with the present invention, there is initially provided a conventional drawer arrangement having at least one upwardly-opening drawer supported on a cabinet and horizontally movable from a closed position wherein the drawer front closes off a front opening of the cabinet, and an open position wherein the drawer projects horizontally outwardly of the cabinet so that a vertically deep compartment defined by the drawer is vertically accessible. The original drawer typically includes an upwardly-opening box structure defined by a bottom wall which extends between parallel upright end walls (herein the "original" end walls), the latter typically mounting horizontal slide arrangements which also coupled to the cabinet side walls, with the drawer front typically being joined to front edges of the original end walls, such as by screws cooperating between opposed abutting flanges, and with an upright rear wall projecting upwardly from the bottom wall and extending horizontally between rear edges of the original end walls. A drawer insert according to the present invention is mounted to the original drawer by first disassembling or disconnecting the drawer front from the remainder of the original box structure. The drawer insert includes lower and upper insert drawers which are each of shallower compartment depth, with the lower insert drawer having generally parallel upright end panels which are mounted to the drawer front adjacent opposite ends thereof, which mounting preferably is free of threaded fasteners and the like. The inner end panels of the lower insert drawer are sandwiched between and horizontally movably supported on generally parallel upright outer end panels which are fixed to opposite ends of the upper insert drawer. These outer end panels in turn are positioned adjacent and are fixedly coupled to the original end walls, such as by locking tabs provided on the outer end panels to create a snap-type locking engagement with the original box structure end walls. The horizontal slidable connection between the inner and outer end panels enables the insert drawers to be disposed vertically one directly above the other for storage within the cabinet when the door front is in the usual closed position. Movement of the drawer front horizontally outwardly into a first open position pulls the entire insert and box structure outwardly of the cabinet to permit vertical access to the upper insert drawer. Further outward displacement of the drawer front into an extended open position effects release of a detent which cooperates between the adjacent end panels and moves the lower insert drawer horizontally outwardly from beneath the upper insert drawer into a fully extended position, thereby permitting simultaneous vertical access to both the upper and lower insert drawers.

With the improved drawer insert of this invention, as briefly summarized above, a single deep-compartment drawer can be easily converted into a dual-drawer arrangement so as to provide two readily-accessible shallower drawer compartments, which conversion can be effected during manufacture if desired, but more significantly can be easily converted at a use location merely by disconnecting the original drawer front from the remainder of the original drawer box structure, and then assembling and connecting the drawer insert between the drawer front and the original end walls of the drawer box structure, which connection of the drawer insert to the original box structure can in accordance with this invention be carried out without requiring complex or special tools.

Other objects and purposes of the invention will be apparent to persons familiar with structures of this general type upon reading the following specification and inspecting the accompanying drawings.

BRIEF DESCRIPTION OF THE DRAWINGS

In FIG. 1 the top wall of the file cabinet is removed, and only a single drawer is illustrated, for clarity of illustration.

Figure 1:
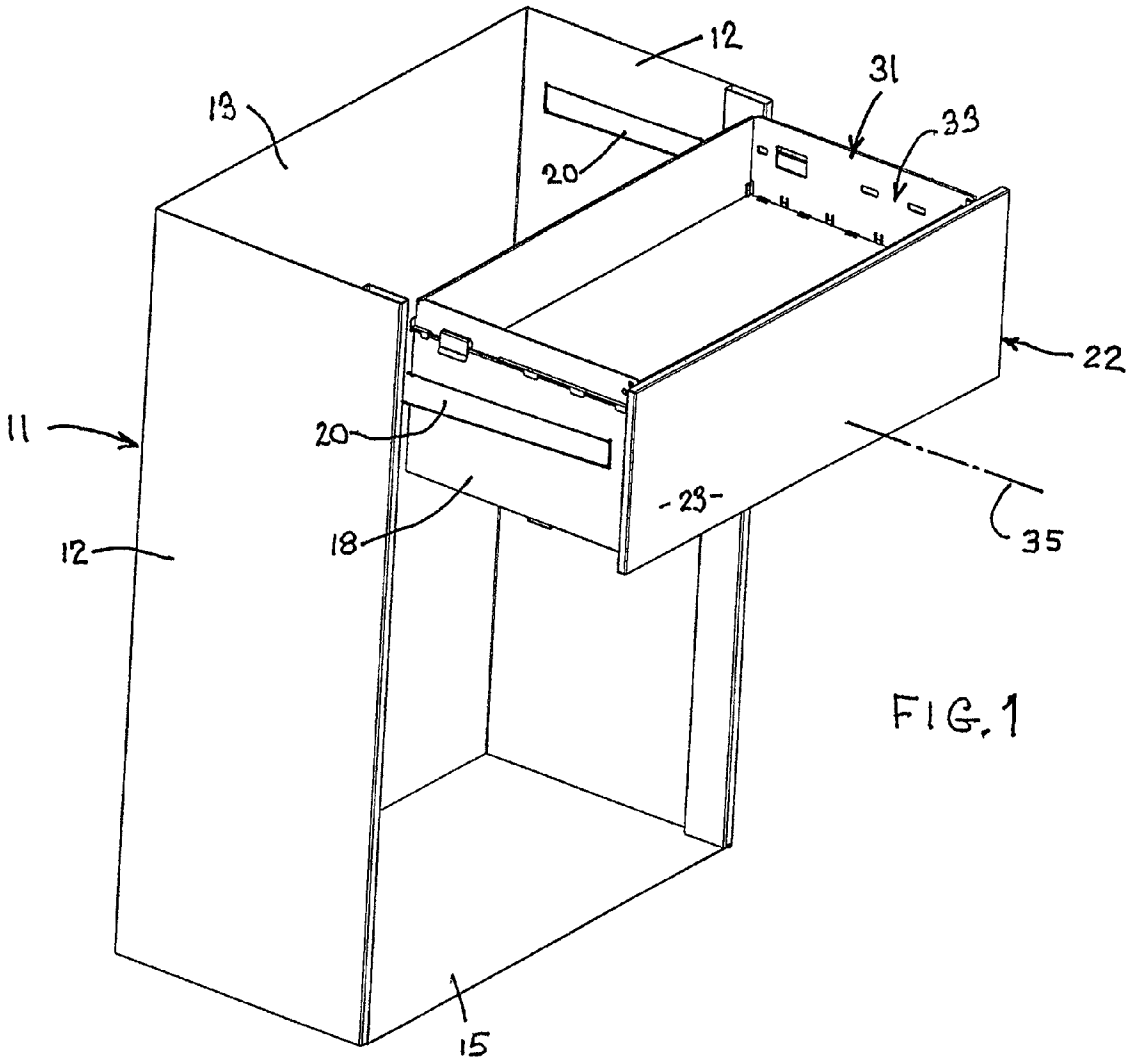
FIG. 1 is a perspective view of a cabinet having a horizontally openable drawer associated therewith, the drawer being shown in a typical open position and having been modified to include a drawer insert according to the present invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the structure and designated parts thereof. The words "inward" and "outward" will also refer to directions of drawer movement, these respectively being movement of the drawer in closing and opening directions. The above terminology will include the words specifically mentioned, derivatives thereof, and words of similar import.

DETAILED DESCRIPTION

Referring initially to FIGS. 25-28, there is illustrated a conventional drawer or file cabinet 10, referred to as a lateral file, defined by a cabinet housing 11 having upright side walls 12 rigidly joined by a back wall 13, a top wall 14 and a bottom wall 15. The cabinet mounts a plurality of horizontally-openable drawers 16, one shown in the horizontally extended open position.

The drawer 16 is formed generally as an upwardly-opening box structure defined by a bottom wall 17 which, in the illustrated construction, has a reinforcing channel 17A extending in the lengthwise extent thereof. A pair of plate like side or end walls 18, herein referred to as the "original" end walls, are fixed to and project upwardly from opposite ends of the bottom wall 17 in generally parallel relationship, and are rigidly joined by a lower-height rear wall 19 which extends horizontally therebetween. This rear wall 19 in the illustrative environment has a generally Z-shape cross section in that the upper portion is offset forwardly from the lower portion, thereby defining a shoulder 21 which faces downwardly of the drawer compartment. A front flange 19A extends along the front edge of the bottom wall. The end walls 18, on the outer sides thereof, has conventional elongate telescopic ball slide arrangements 20 secured thereto, the latter projecting horizontally into the interior of the cabinet for securement to inner sides of the cabinet side walls 12, whereby the telescopic ball slide units 20 permit full extension of the drawer when in the illustrated open position.

The drawer 16 also includes a generally vertical drawer front 22 which closes off a front side of the drawer and is secured to the end walls 18. In this regard, the front edges of the end walls 18 have suitable flanges which in turn overlap rear flanges on the drawer front, which overlapping flanges accommodate threaded fasteners such as screws to fixedly secure the drawer front 22 to the drawer body. The upper edges of the end walls 18 are also typically provided with a rolled or bent-over top flange extending therealong.

Figures 26, 27, 28:
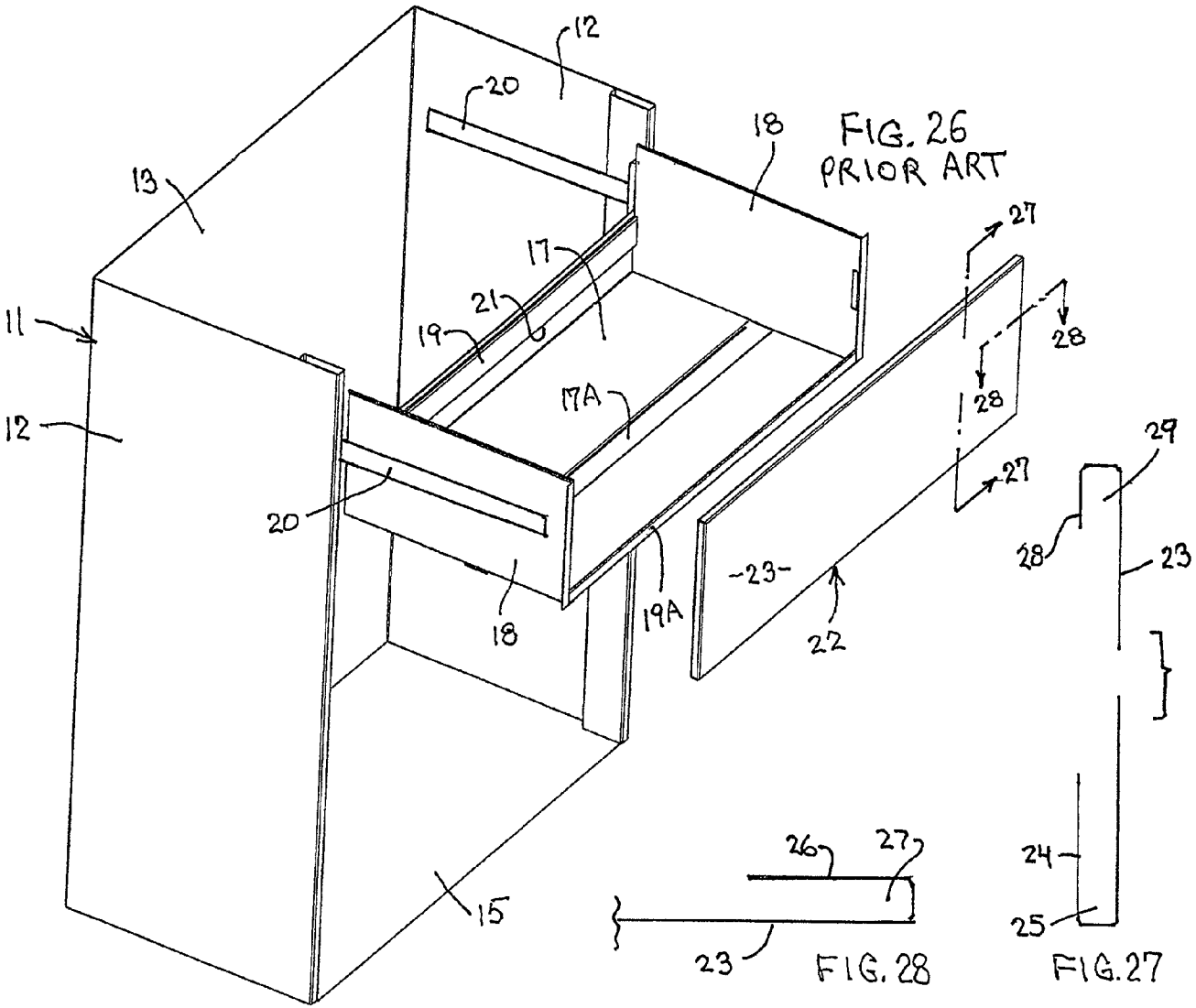
FIG. 26 PRIOR ART
FIG. 26 illustrates the cabinet of FIG. 25 but with the drawer front disconnected from the end walls associated with the original box structure.
FIG. 27 is an enlarged sectional view which illustrates the channel structures which define and extend lengthwise along the upper and lower edges of the conventional drawer front.
FIG. 28 is a fragmentary sectional view which illustrates the channel structure which extends vertically along the end edges of the conventional drawer front.

The drawer front 22 is defined primarily by a sheet-like front wall 23, typically a thin metal sheet. The edges of the drawer front are defined by deformed channel structures which extend along the respective edges. For example, as illustrated in FIG. 27, the upper edge of the drawer front is defined by a channel structure 29 which defines an inner upper edged flange 28 spaced rearwardly a small distance from the front panel 23. In similar fashion the lower edge of the drawer front has a channel structure 25 defining a rear flange 24 spaced from the front panel 23. And, as illustrated in FIG. 28, each vertical edge is defined by a channel 27 having a rear flange 26 spaced rearwardly from the front panel 23.

Examples of known constructions of cabinets of this general type are U.S. Pat. Nos. 7,275,799 and 4,692,984 both owned by the Assignee hereof.

Figure 2:
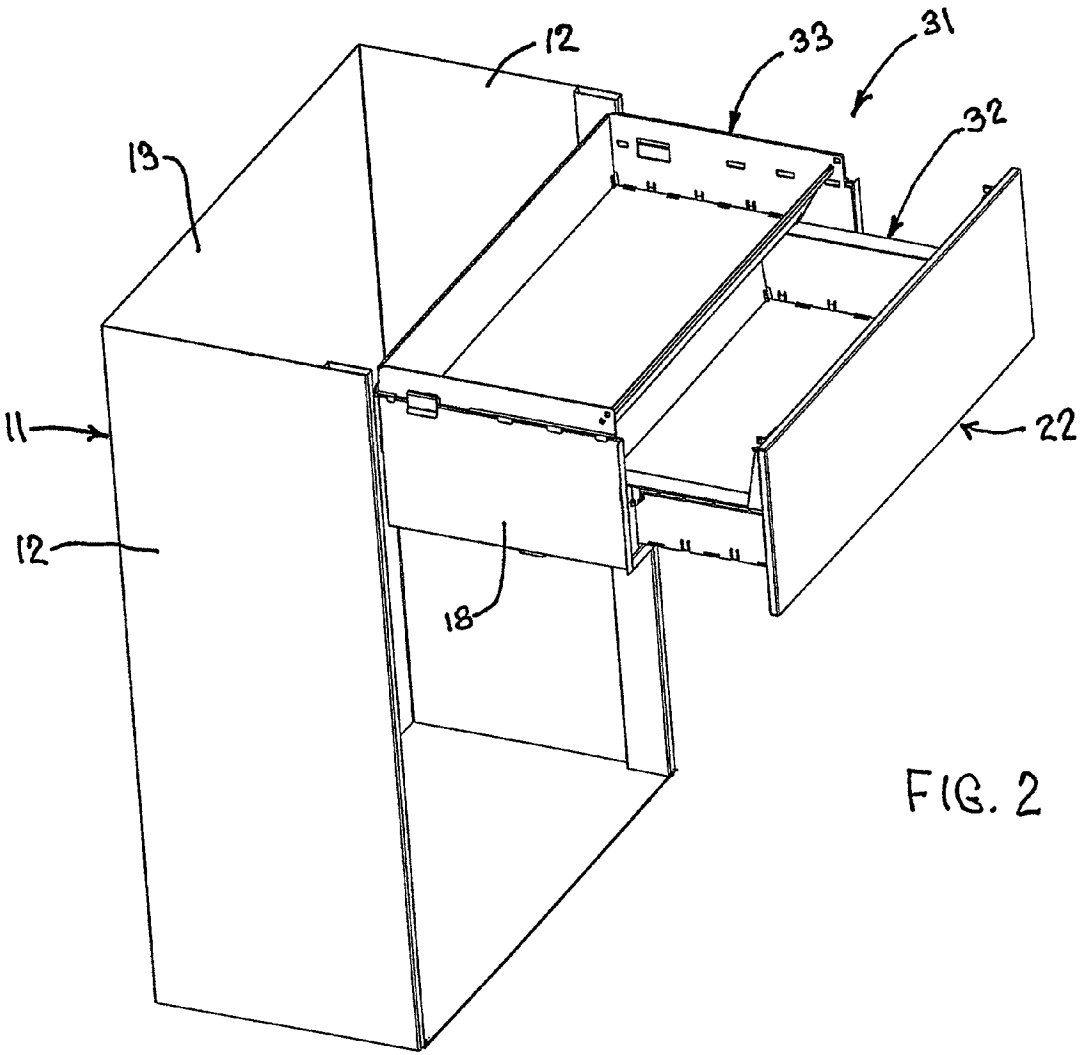
FIG. 2 is a perspective view similar to FIG. 1 but illustrating the drawer, with the drawer insert mounted thereon, in its fully opened position to provide simultaneous vertical access to both the upper and lower insert drawers.
Figure 3:
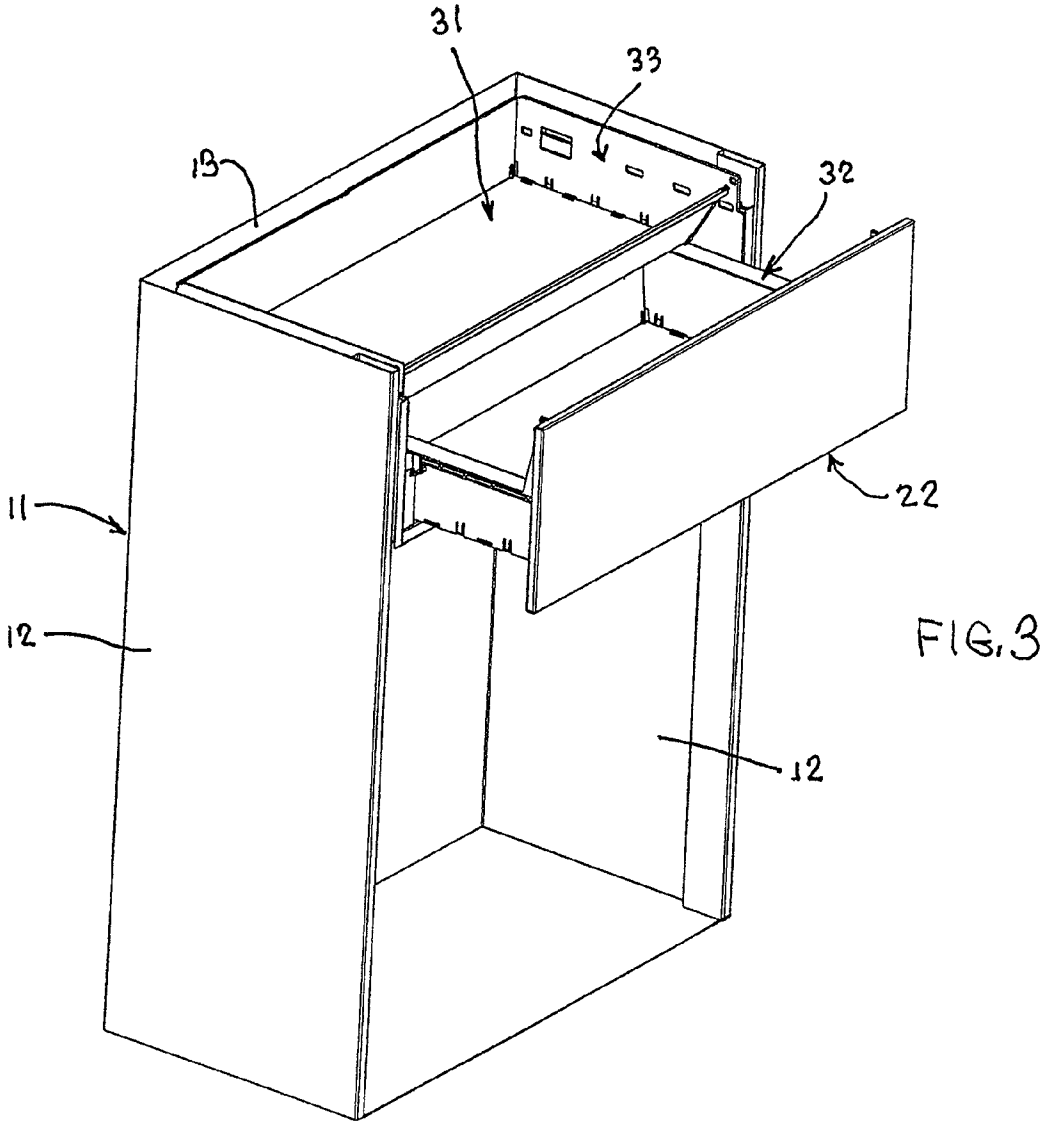
FIG. 3 is a perspective view similar to FIGS. 1 *and* 2 but illustrating the drawer in a partially open position so that only the lower insert drawer is vertically accessible, the upper insert drawer being in its storage position within the cabinet (the top wall of the cabinet being removed for purposes of illustration).
Figure 4:
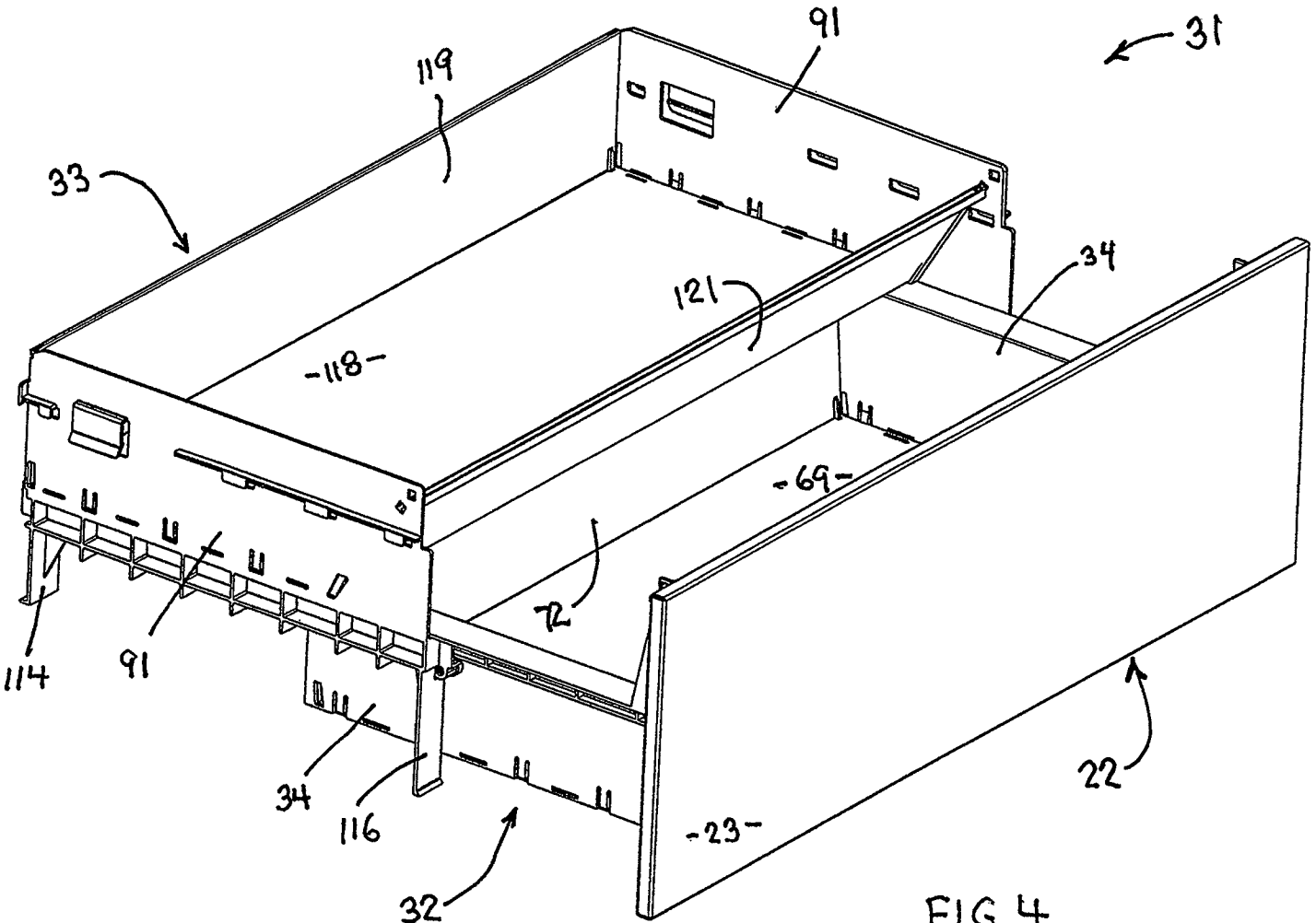
FIG. 4 is a perspective view of solely the assembled drawer insert according to the present invention, the insert being illustrated with the lower drawer in its extended position relative to the upper drawer.

In accordance with the present invention, and as illustrated by FIGS. 1-3, a drawer insert 31 is provided and positioned for structural cooperation with and between the original drawer front 22, after the latter has been decoupled from the drawer box as illustrated in FIG. 26, and the original end walls 18. The drawer insert 31 includes a top drawer assembly 33 which mounts on and moves with the original drawer box end walls 18. This top drawer assembly 33 in turn horizontally slidably supports thereon a bottom drawer assembly 32 which, as illustrated in FIG. 2, can be horizontally displaced outwardly from the top drawer assembly 33 into an extended or access position. This bottom drawer assembly 33 in turn directly couples to and carries the original drawer front 22. The drawer insert 31, when coupled between the drawer front 22 and the original drawer box end walls 18, hence enables multiple open positions, namely an open position of FIG. 1 wherein the original drawer box is in its open position and only the upper drawer assembly 33 is vertically accessible, in which position the lower or bottom drawer assembly 32 is hidden by being disposed directly under the upper drawer assembly 33. The drawer insert 31 also allows the drawer front 22 to be additionally moved outwardly from the open position of FIG. 1 into an extended open position as shown in FIG. 2, in which latter position the bottom drawer assembly 32 is extended horizontally outwardly relative to the upper drawer assembly 33, in which extended open position both drawer assemblies 32 and 33 are vertically accessible. Lastly, as illustrated in FIG. 3, the original drawer box structure and the top drawer assembly 33 carried thereon can be maintained in a stored or closed position within the cabinet, with only the drawer front 22 and the bottom drawer assembly 32 being extended outwardly into an open position, in which position only the bottom drawer assembly 32 is vertically accessible.

Considering now the construction of the drawer insert 31 and referring specifically to FIGS. 9-14 and 18, the bottom drawer assembly 32 includes a pair of end support panels 34 which are generally parallel upright members disposed in opposed facing relationship on opposite sides of a horizontal center line 35 (FIG. 1) which represents the opening/closing direction of the drawer relative to the cabinet. These end panels 34, which will herein be referred to as "inner" end panels, are effectively right and left members which are basically mirror images of one another, and each is preferably constructed as a one piece plastic member formed by molding or other suitable forming process.

Each inner end panel 34 has a main upright side wall 36 provided with a flange arrangement 37 (FIG. 11) formed thereon and protruding horizontally upwardly through a small extent. This flange arrangement 37, in its entirety, has a generally upward-opening channel shaped configuration defined by a generally horizontally-extending bottom flange 38 extending along a lower edge of the upright wall 36. This bottom flange 38 at its rearward end joins to a vertically upright rear flange 39 defined at a rear edge of the upright wall 36. The other end of bottom flange 38 joins to a front flange 41 which projects upwardly while being slightly outwardly inclined toward a front edge of the upright wall 36. The flange arrangement 37, which functions as a seat for a drawer member as explained hereinafter, has a plurality of locking projections 42 (FIG. 18) formed on and projecting upwardly from the base flange 38. The projections 42 are horizontally elongated, and are disposed in spaced but aligned relationship along the front-two-back extent of the bottom flange 38. The upright side wall 36, directly above but adjacent the bottom flange 38, also has a plurality of downwardly-cantilevered tabs 43 formed therein with the lower free end of each tab 43 being deformed inwardly to overly the adjacent bottom flange 38. The tabs 43 function as defectable springs to facilitate the installation and subsequent securement of the drawer member as described hereinafter.

Figure 12:
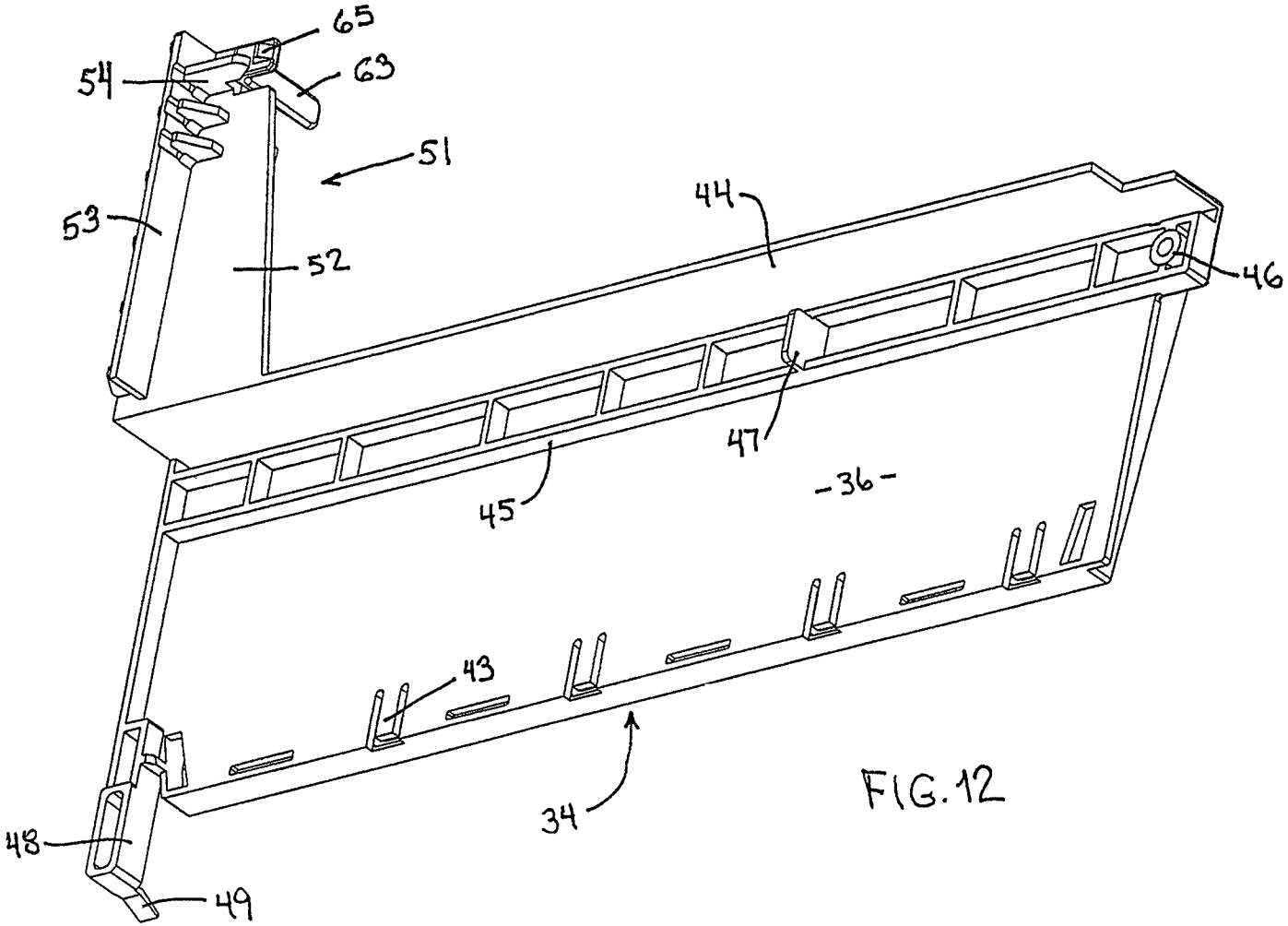
FIGS. 12 and 13 are perspective views of the end panel associated with the lower insert drawer and principally showing details associated with the outer side thereof.

The inner end panel 34 has a generally horizontal top flange 44 which extends lengthwise along the main upright wall 36 and is cantilevered outwardly toward the outer side thereof. The main upright wall 36, on the outer side thereof (FIG. 12), in close proximity to the top flange 44, is provided with a generally horizontally elongate bottom flange or rib 45 which extends horizontally across the outer face of the main side wall in generally parallel relationship to but spaced slightly downwardly a small distance from the top flange 44. This bottom flange 45 defines thereon a flat bottom surface extending lengthwise therealong that functions as a guide rail. The top flange 44 and bottom rail 45 are, as illustrated in FIG. 12, preferably joined together by a plurality of reinforcing ribs. In addition, the inner end panel 34 has a generally cylindrical support hub or sleeve 46 integrally formed thereon adjacent the rearward edge thereof. The support hub 46 is located generally between the flanges 44 and 45, and defines a generally cylindrical bore or opening extending horizontally therethrough in generally perpendicular relationship to the side wall 36. The inner end panel 34 also has a stop 47 which is fixed to and is cantilevered outwardly away from the outer side of the side wall 36. This stop 47 is formed generally as a flat tab which extends generally vertically between the flanges 44 and 45, and protrudes outwardly therefrom. The stop tab 47 is located intermediate the front and rear edges of the inner end panel 34, and more specifically is displaced horizontally from the rear edge of the end panel 34 by a distance which is approximately one-third of the distance between the front and rear edges of the inner end panel.

Figure 11:
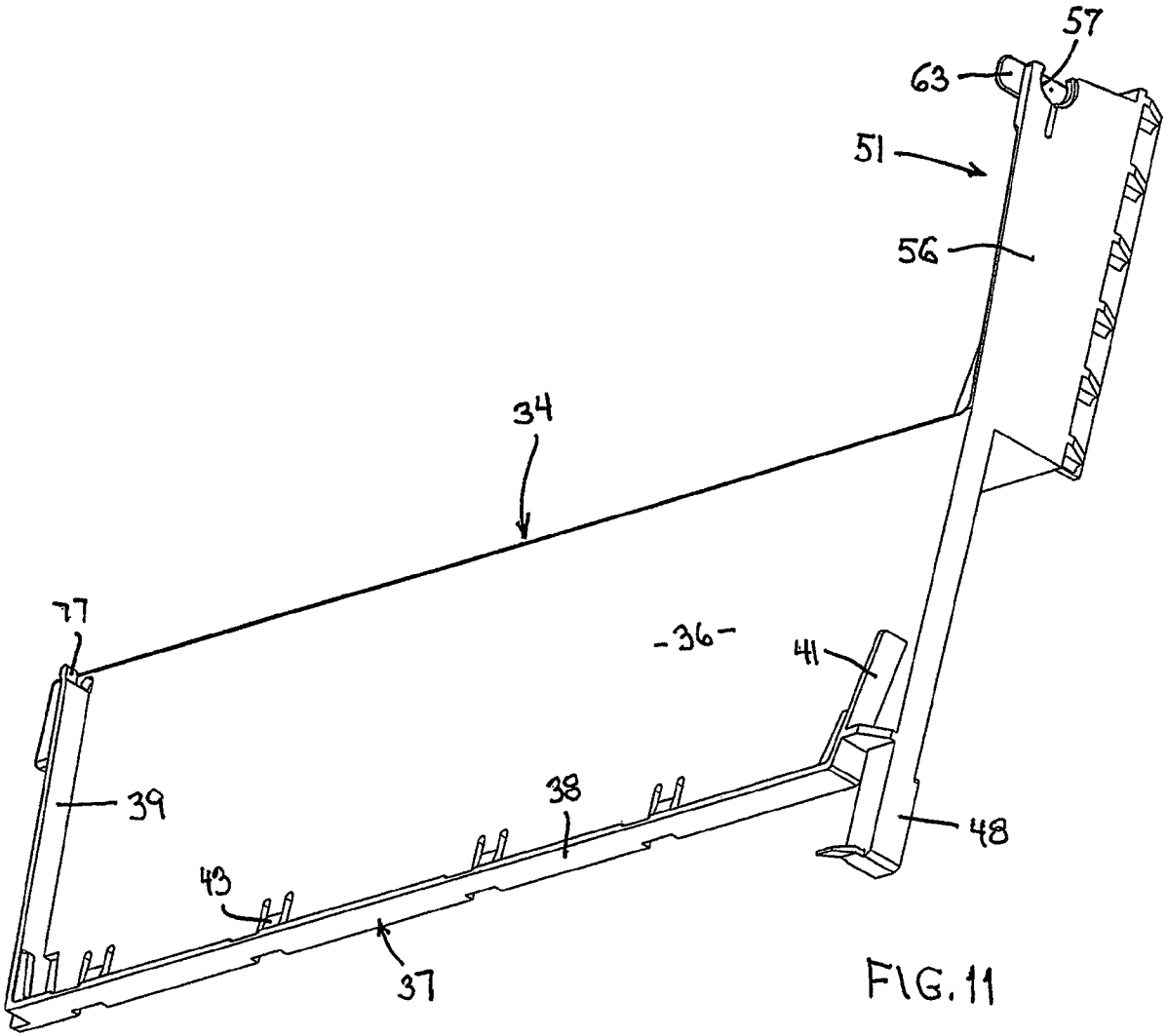
FIG. 11 is a perspective view of the end panel associated with the lower insert drawer and principally showing the inside surface thereof.
Figure 13:
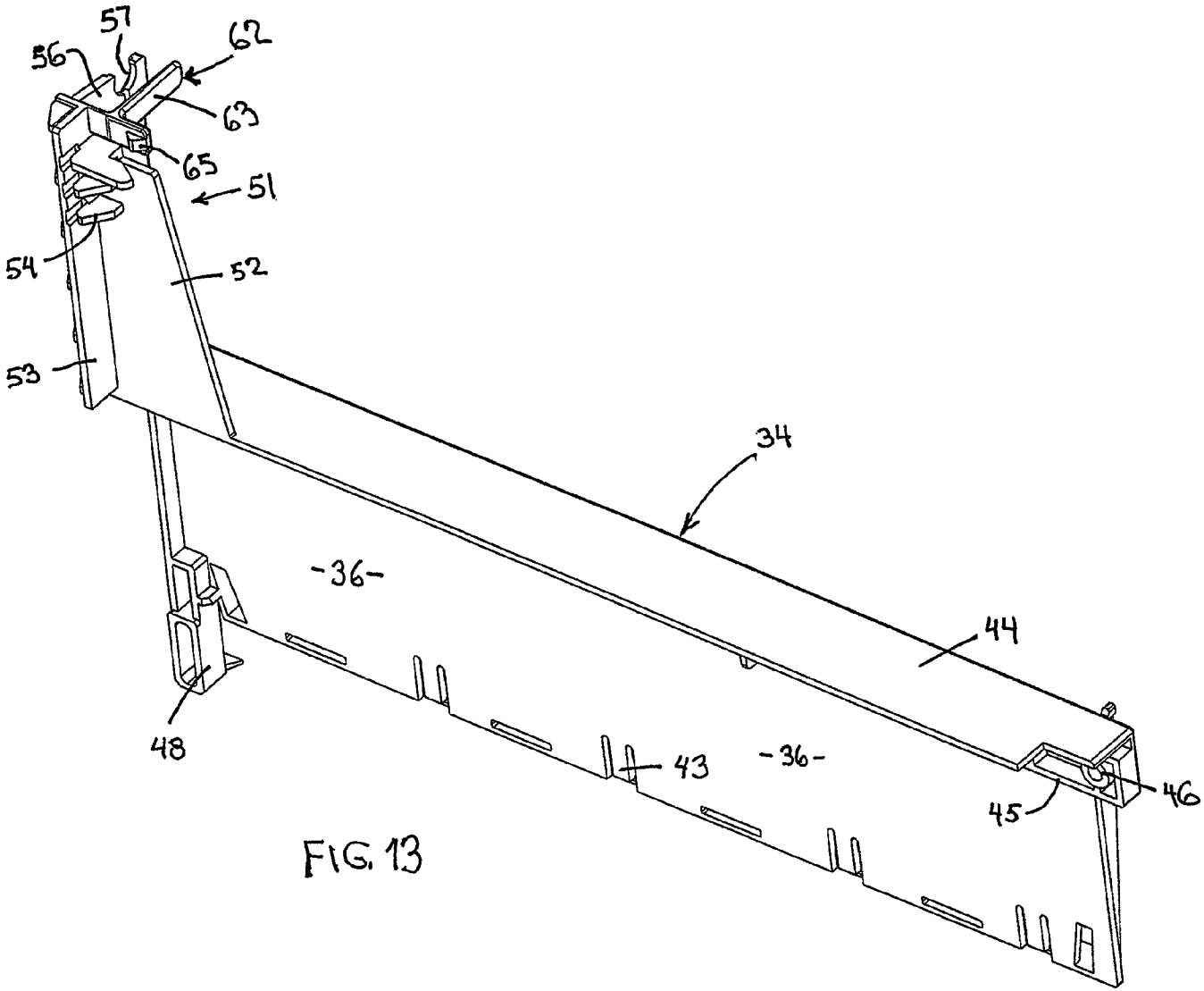

As illustrated by FIGS. 11-13, the inner end panel 34 has a front bottom leg 48 which is cantilevered downwardly along the front edge of the end panel through a defined distance, and which adjacent the lower free end is provided with a downwardly sloped spring tab 49 terminated in a free end. The leg 48 has a width, as defined between front and back side walls thereof, which generally corresponds to the width of the channel 25 (FIG. 27) formed along the lower edge of the drawer front 22 so that the leg 48 can be slidably inserted and seated therein.

Each inner end panel 34 also has an upright column structure 51 which is disposed adjacent the front edge of the main side wall 36 and which is cantilevered upwardly above the top flange 44. This column 51 includes a main upright support plate 52 which is joined to the flange 44 and is cantilevered upwardly therefrom in sidewardly offset relationship from the main sidewall 36. A side flange 53 is joined to the main upright support plate 52 and extends vertically upwardly therealong, and is cantilevered generally perpendicularly therefrom. The main support plate 52 and the side flange 53, adjacent the upper end thereof, are joined by a plurality of vertically-spaced horizontal tabs 54 disposed in the vicinity of the upper end of the column 51. These tabs 54, and their cooperation with the side flange 53, define a narrow slot 55 (FIG. 14) which extends horizontally inwardly and extends vertically upwardly adjacent a side face of the side flange 53. This slot 55 accommodates therein the rear side flange 26 (FIG. 28) associated with the door front 22, while enabling the rear flange 53 to be slidably inserted into the channel 27 defined between the front panel of the door front 22 and the rear flange 26 thereof.

Figure 14:
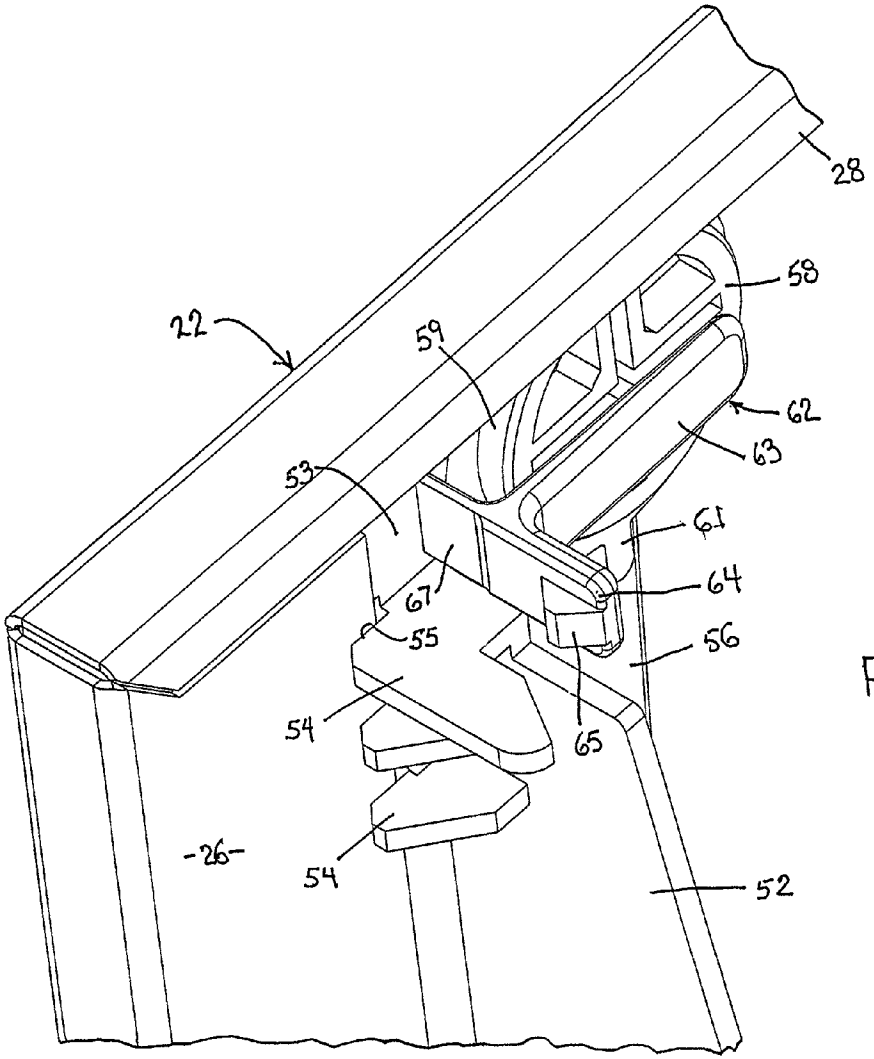
FIG. 14 is enlarged, fragmentary perspective view illustrating the connection of the inner end panel, as associated with the lower insert drawer, to the original door front in the vicinity of an upper corner thereof.
Figure 15:
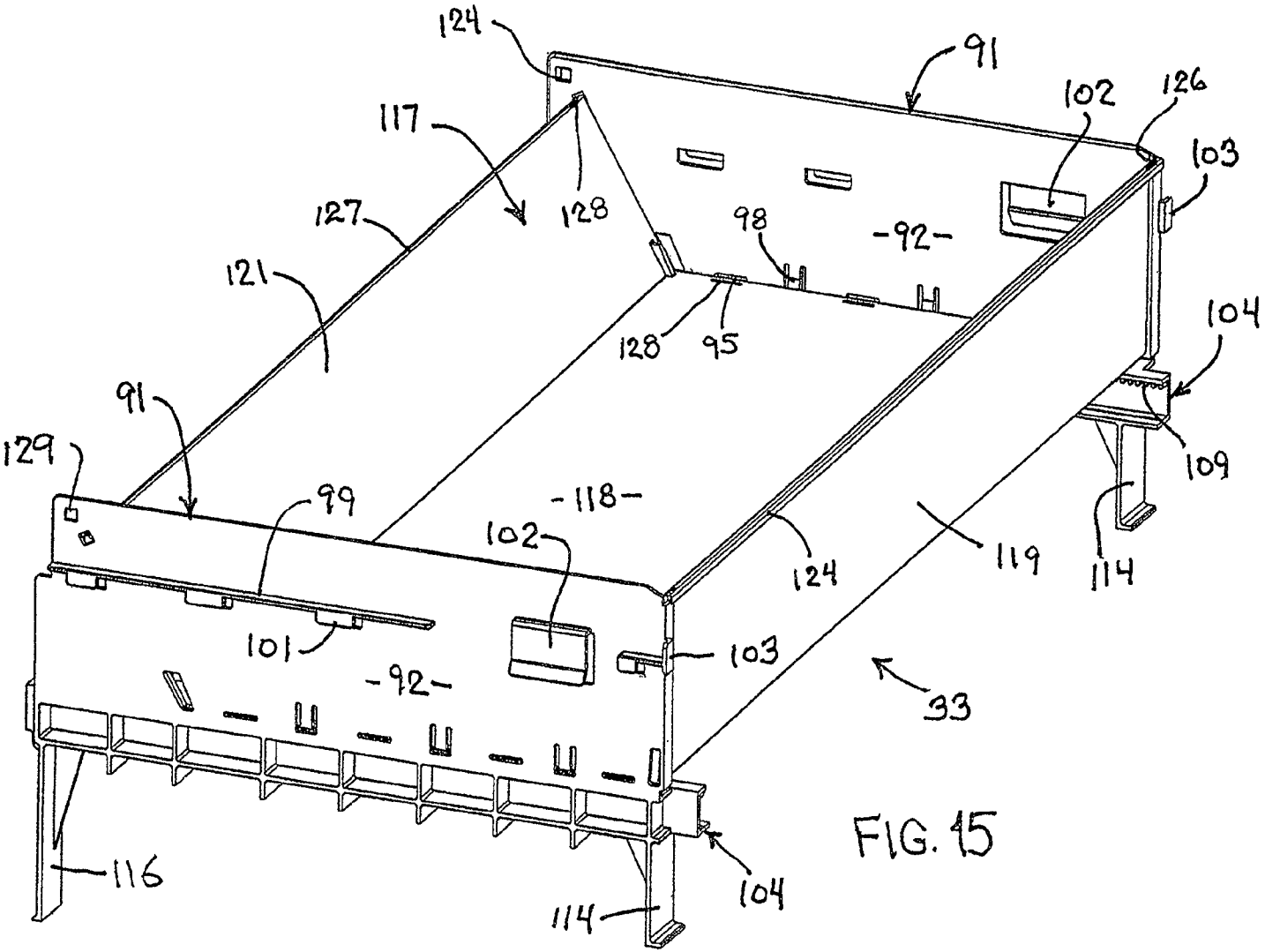
FIG. 15 is an upper rear perspective view of the assembled upper insert drawer arrangement.
Figure 16:
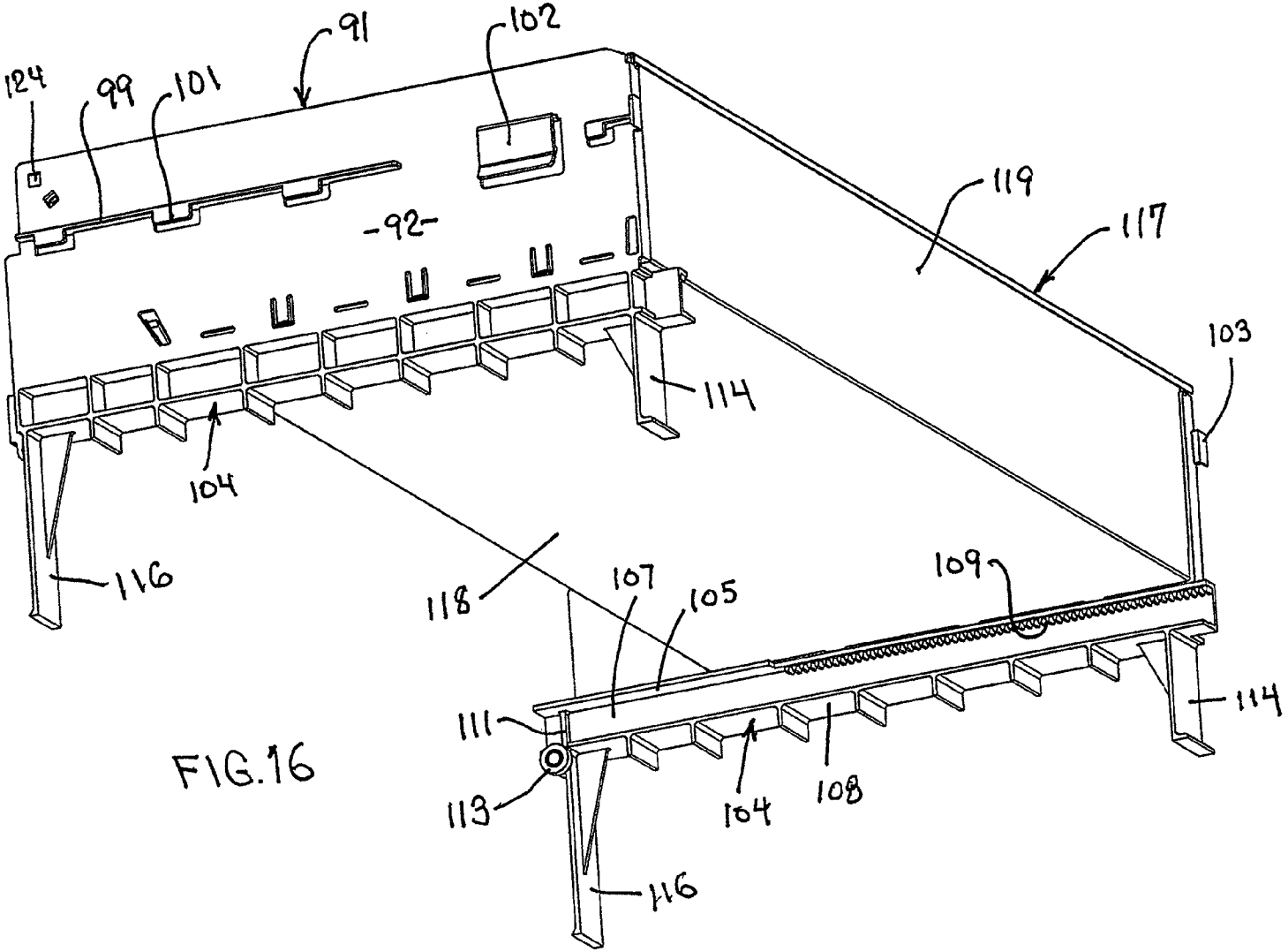
FIG. 16 is a perspective view, taken generally from below, of the assembled upper insert drawer arrangement of FIG. 15.
Figure 17:
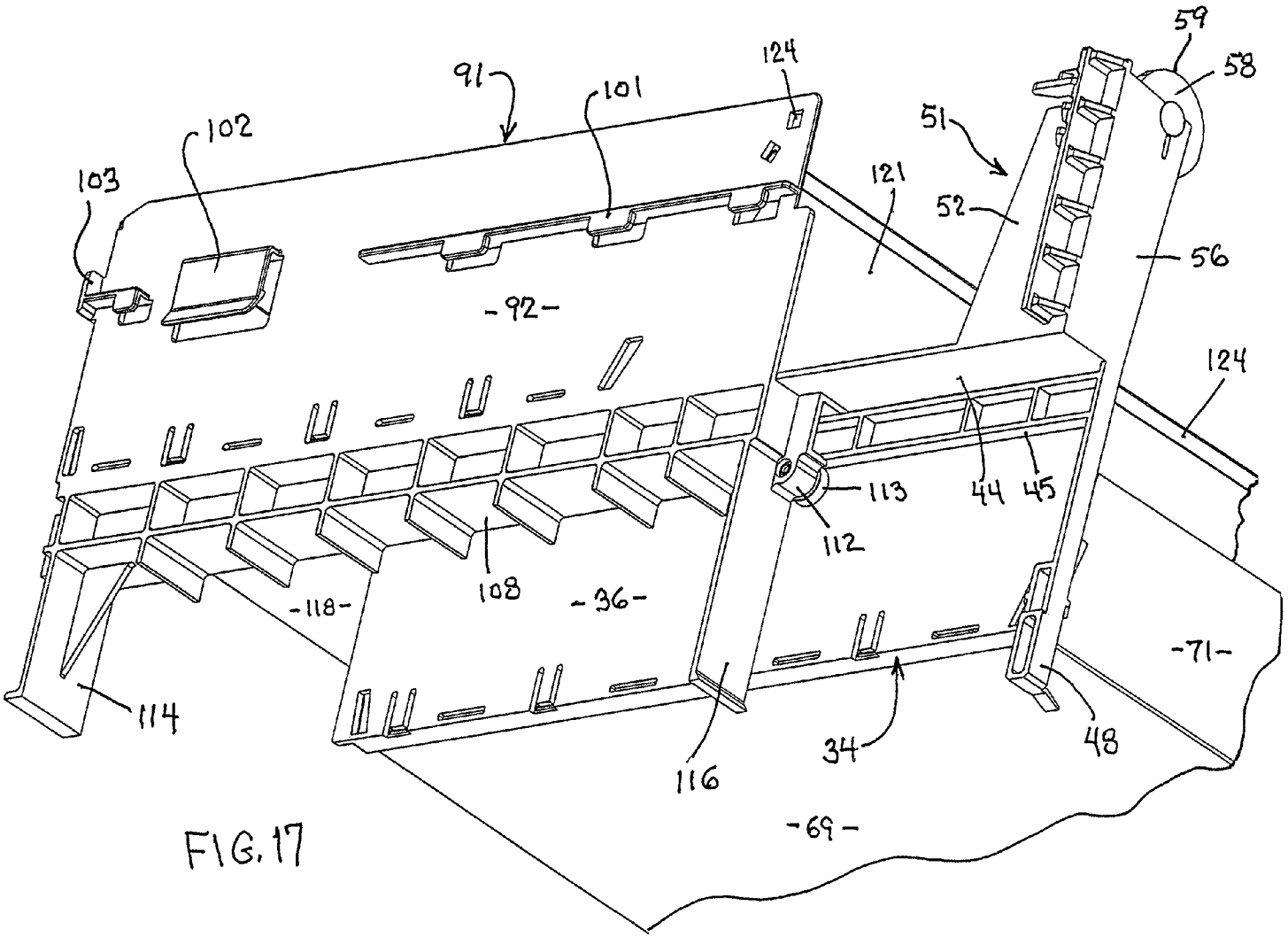
FIG. 17 is a fragmentary perspective view showing the upper insert drawer and its end panel, and its cooperative relationship with the adjacent end panel of the lower insert drawer, the latter being illustrated in a partially horizontally extended position relative to the upper insert drawer.
Figure 18:
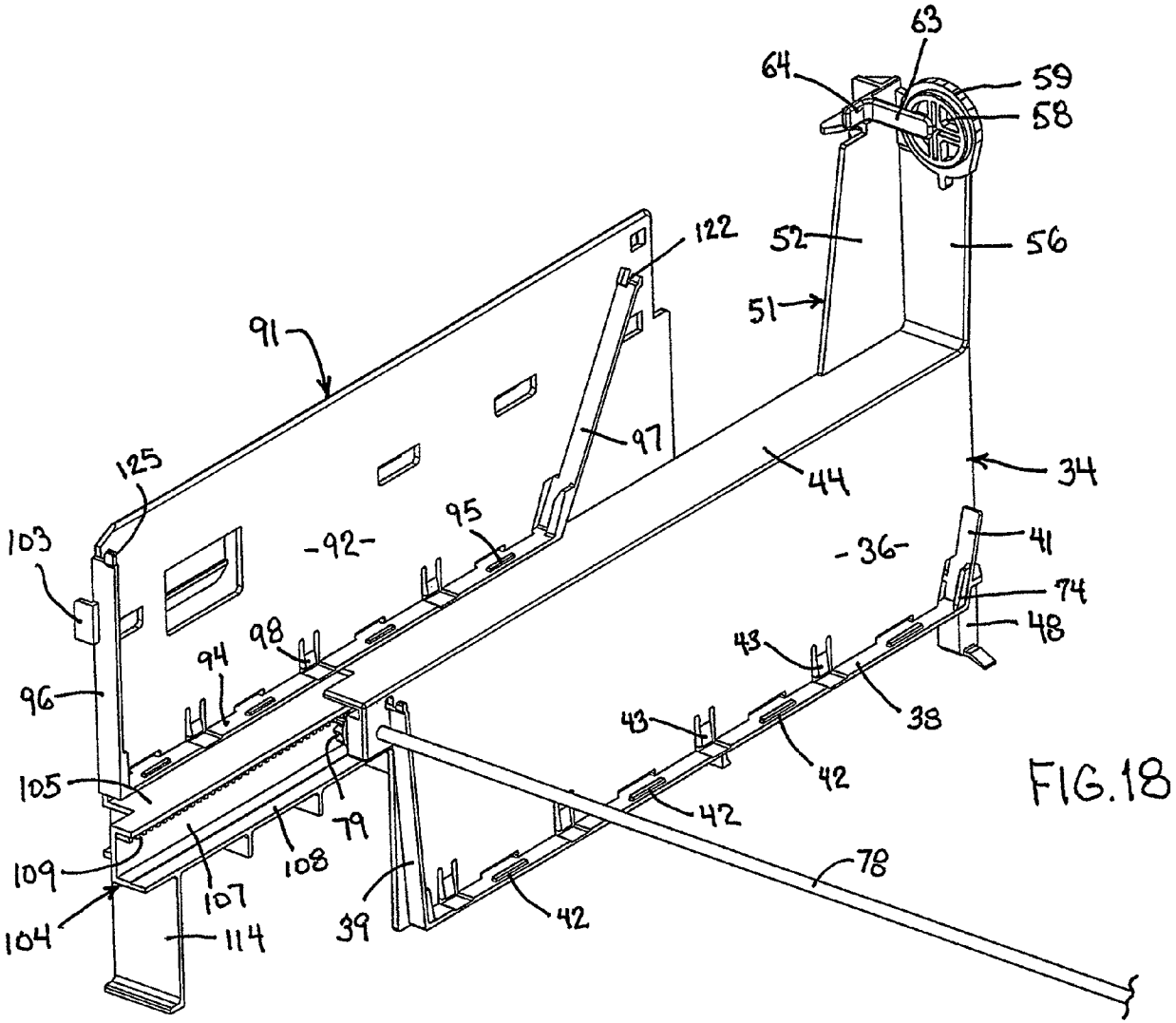
FIG. 18 is a perspective view which shows the cooperation between the adjacent end panels corresponding generally to FIG. 17, but showing the inner sides of the end panels.

The upright column 51 also includes a generally vertically extending front flange 56 (FIG. 14) which is joined to and extends generally perpendicularly from the support plate 52 and protrudes inwardly therefrom in an opposite direction from the side flange 53. This front flange 56 (FIGS. 11 and 14) extends along the front edge of the end panel 34 and is effectively an extension of the outer or front wall of the lower support leg 48. The flange 56, adjacent its upper free end, has an arcuate recess 57 formed therein which rotatably supports a disc like support cam 58, the latter having an exterior peripheral cam surface 59 which is eccentric relative to the rotational center of the cam. The cam 58 also has a radially projecting finger tab 61 so that the cam can be manually rotated within the recess 57 so as to move the peripheral eccentric cam surface 59 to vary its point of engagement with the top edge wall of the door panel 22 when the cam is projected into the top channel 28 of the door front 22 as illustrated in FIG. 14.

The upper end of column 51 also mounts thereon a detent member 62 which is generally L-shaped and is defined by a generally horizontally elongate finger arm 63 which is cantilevered horizontally at a location generally behind the cam 58 so as to be positioned in close proximity to the upper edge of the door front 22. The finger arm 63 is joined to a detent arm 64 which protrudes generally horizontally inwardly in right angle relationship to the arm 63, and which adjacent its free end is provided with a generally tapered protrusion 65 protruding sidewardly therefrom in the vicinity of the free end thereof. The detent member 62, in the vicinity of the apex between the arms 62 and 63, is joined to a thin flexible support tab 67 so as to enable the detent member 62 to be horizontally angularly displaced. The support tab 67 is rigidly joined to the support plate 52.

The lower drawer assembly 32, in addition to the right and left inner end panels 34 described above, also includes a generally one-piece bottom drawer member 68 (FIGS. 9 and 10) which is horizontally elongated so as to extend between and rigidly couple to the right and left end panels 34. This drawer member 68 has an upwardly-opening channel like cross section and is defined primarily by a generally horizontal bottom wall 69 which at one edge joins to a front wall 71 which projects upwardly at an outward slope or incline. The other edge of bottom wall 69 joins to a rear wall 72 which projects upwardly in generally perpendicular relationship to the bottom wall 69. The rear wall 72 projects upwardly through a height which generally corresponds to the height of the side walls 36, and rear wall 72 at its upper edge has a top flange or hem 75 formed thereon. The front wall 71 will typically project upwardly through a height which is less than the height of the rear wall, with the upper free edge of the front wall 71 being positioned so as to lie in close proximity to the front panel 23 when the bottom assembly 32 is secured to the drawer front 22.

The drawer member 68 is seated and secured to the right and left inner end panels 34 by seating the bottom wall 69 on the horizontal bottom flanges 38 so that the projections 42 thereon protrude upwardly into elongate slots 73 formed through the bottom wall 69 adjacent the end edges thereof. When the bottom wall 69 is being seated on the bottom flanges 38, the spring tabs 43 deflect outwardly to allow the bottom wall 69 to be properly seated, following which the cantilevered spring tabs 43 elastically deflect inwardly back to their original positions, in which positions the lower ends of the tabs 43 overly the upper surface of the bottom wall 69 adjacent the end edges thereof, thereby preventing the bottom wall 69 from lifting upwardly away from the bottom support flanges 38.

In addition, the inclined front flange 41 has a tab 74 thereon which protrudes through a slot associated with the front wall 71 to assist in securing the front wall relative to the end panels. Lastly, the top hem 75 on the rear wall 72, adjacent the ends thereof, has openings 76 (FIG. 9) which receive therein small fingerlike flanges 77 (FIG. 11) which protrude upwardly from upper ends of the rear flanges 39 so as to assist in restraining the rear wall 72 and effecting a proper seating and securement of the drawer member 68 to the right and left end panels 34.

Figure 10:
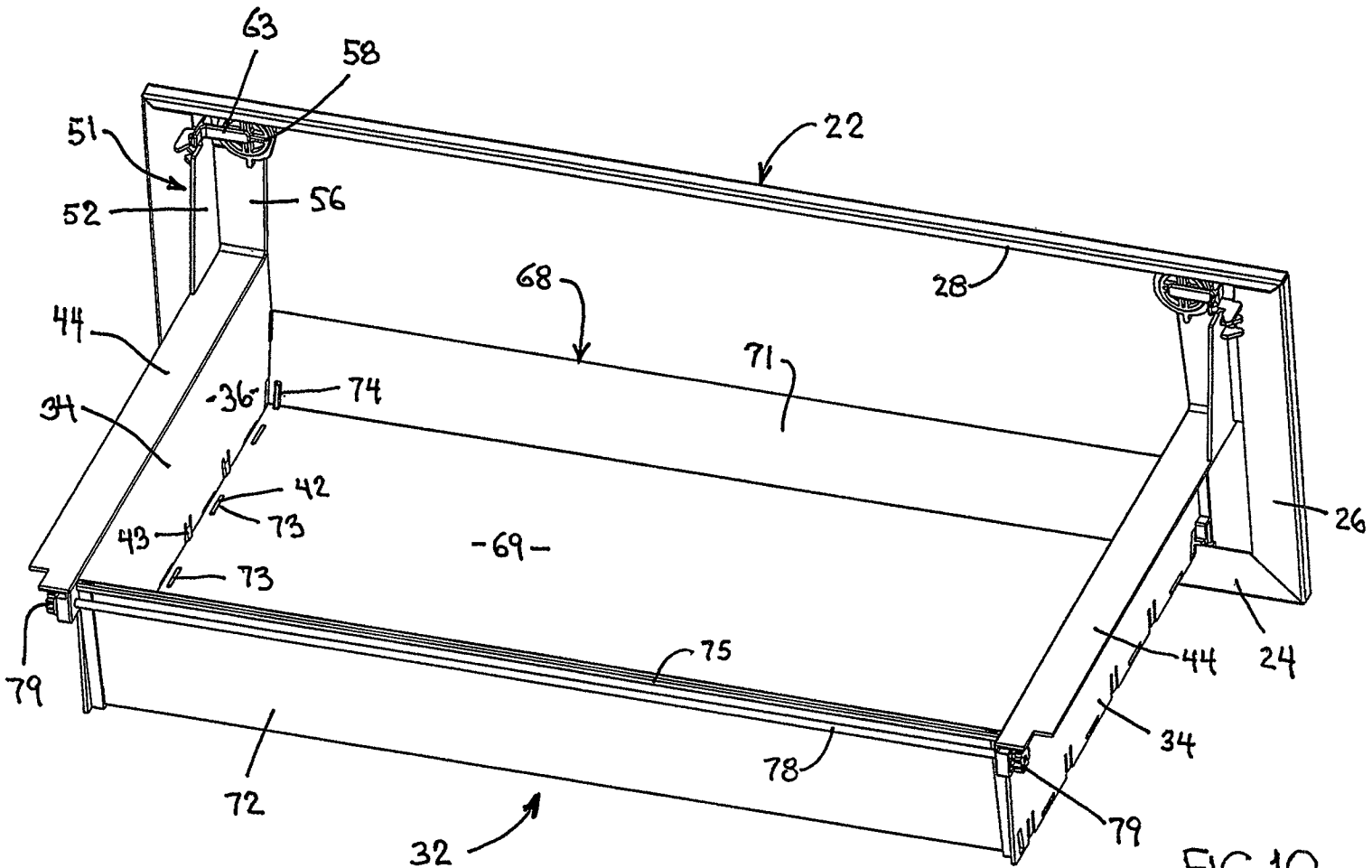
FIG. 10 is a rear perspective view showing the lower insert drawer assembled to the original drawer front.

With the bottom drawer member 68 and end panels 34 assembled as described above, the bores defined by the support hubs 46 are horizontally aligned in close proximity to but directly rearwardly of the upper edge of the rear wall 72. A support shaft 78 is extended horizontally between and supported within the aligned hubs 46 so that the free ends of shaft 78 protrude outwardly beyond the support hubs. The protruding ends of the support shaft 78 are each provided with an anti-racking gear 79 nonrotatably mounted thereon. The gear and the mounting end of the shaft 78 are provided with a suitable key-type structure so that the anti-racking gears 79 are nonrotatably coupled to the shaft 78. The gears 79 hence are positioned and rotatably supported directly adjacent the upper rear corners of the lower drawer assembly, generally below the rear end of the top flanges 44, substantially as illustrated in FIG. 10.

Considering now the top drawer assembly 33, and referencing specifically FIGS. 4-9 and 15-18, this top drawer assembly includes a pair of generally parallel and sidewardly spaced upright end or mounting panels 91 which effectively define right and left end panels disposed as mirror images of one another on opposite sides of a center vertical plane which contains the horizontal centerline 35. These end panels 91, like the inner end panels 34, are preferably formed of a plastics material and can be molded or formed by any other suitable process. The end panels 91 are herein referred to as "outer" or support panels since they are disposed sidewardly adjacent but outwardly of the respective right and left inner side panels 34 as associated with the bottom drawer assembly 32.

Each outer end panel 91 includes a main upright side wall 92 which, on the inner surface thereof, is provided with a mounting flange arrangement 93 (FIG. 9) which projects inwardly a small distance from the side surface. This flange arrangement 93, in vertical profile, has a generally upwardly-opening channel-shaped configuration and is defined by a generally horizontally elongate bottom or base flange 94 which extends horizontally of the side wall 92 at a location adjacent a lower edge thereof. This base flange 94 has a plurality of positioning projections or ribs 95 projecting upwardly from the upper surface thereof, which ribs are individually horizontally elongated, and the plurality of ribs are generally horizontally aligned in spaced relationship along the front-to-back direction of the base flange 94. The flange arrangement 93 includes a rear flange 96 which joins to the rear end of the base flange 94, and which projects vertically upwardly along a rear edge of the main side wall 92. The other or front end of base flange 94 joins to a front flange 97 which projects upwardly, and is inclined outwardly as it projects upwardly, so as to terminate at a upper free end which is disposed in close proximity to a front edge of the side wall 92. The side wall 92, at a location adjacent but just above the base flange 94, has a plurality of downwardly-cantilevered spring tabs 98 formed therein, which tabs have the lower free ends thereof inclined inwardly so as to be disposed closely adjacent and directly over the bottom flange 94.

The flange arrangement 93 associated with the inner surface of each end panel 91 cooperates with an adjacent end of a top drawer member, as explained hereinafter, for effecting fixed securement of the top drawer member to the respective end panel 91.

Figure 6:
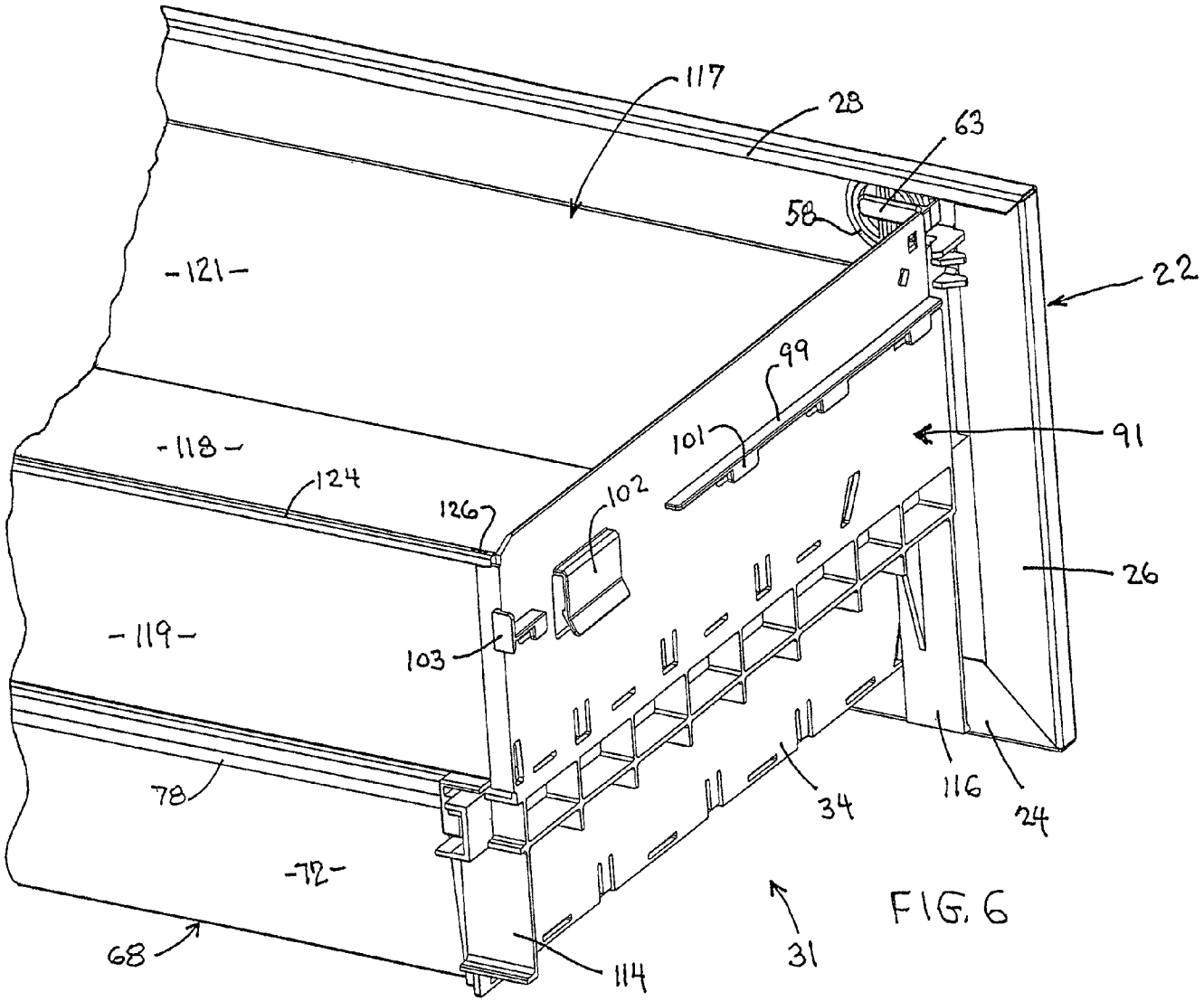
FIGS. 6 and 7 are fragmentary rear perspective views which show the assembled drawer insert according to FIG. 5 but on an enlarged scale.
Figure 7:
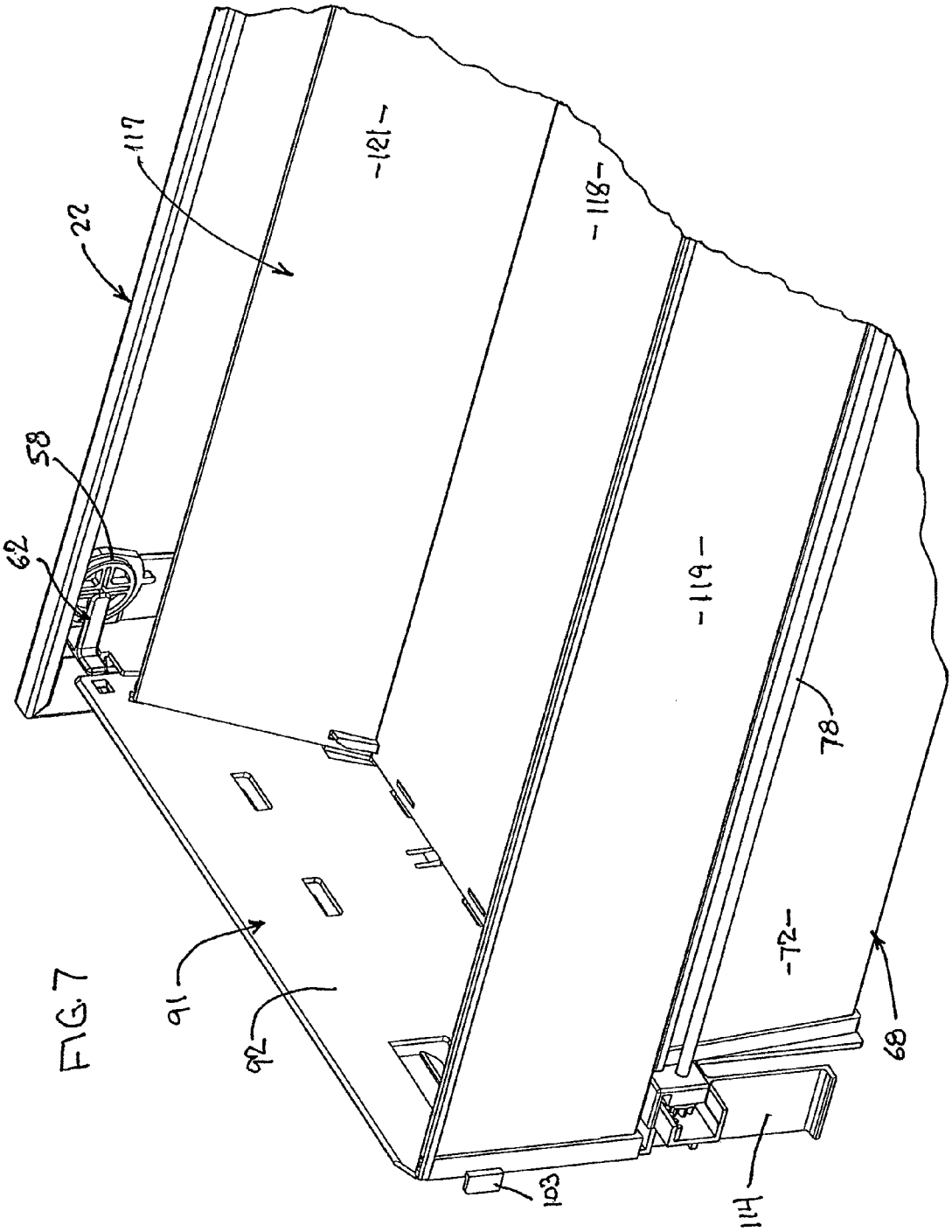
Figure 8:
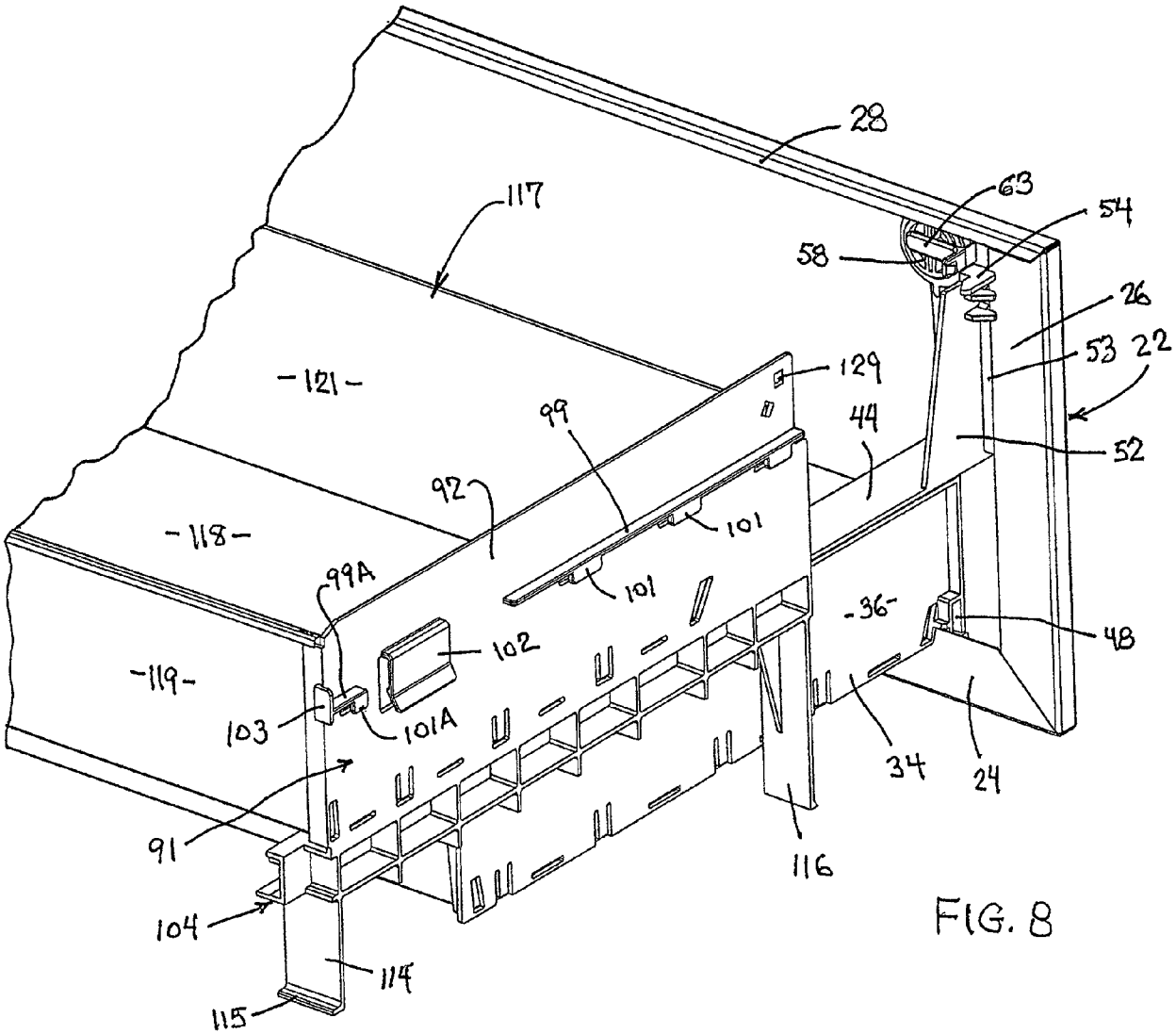
FIG. 8 is a view which corresponds generally to FIG. 6 but illustrates the lower insert drawer in a partial horizontally extended or open position relative to the upper insert drawer.
Figure 9:
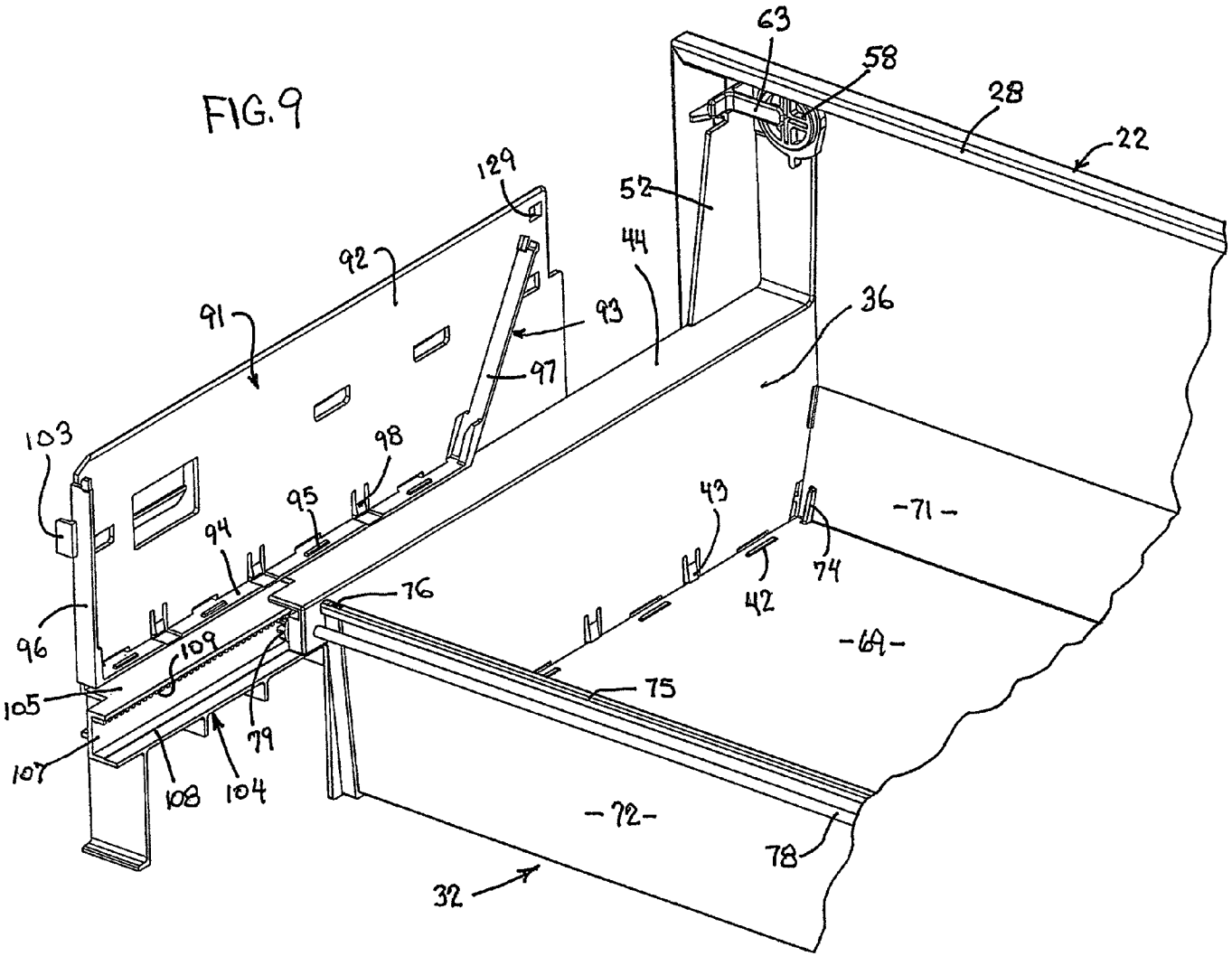
FIG. 9 is a view which corresponds to FIG. 7 but shows the lower insert drawer in a partial horizontally extended or open position relative to the end panel associated with the upper insert drawer, the upper drawer member being eliminated for clarity of illustration.

Referencing now the outer side of the end panel 91, as illustrated in FIGS. 6 and 8, a generally horizontally elongate flange 99 is fixed to the side wall 92 and protrudes outwardly therefrom at a location spaced a small distance downwardly from an upper edge thereof. This flange 99 projects rearwardly from a front edge of the sidewall 92 through a significant portion of the depth thereof, and at several spaced locations therealong the flange 99 supports a plurality of small tabs 101 which are cantilevered downwardly and are sidewardly spaced outwardly from the exterior side surface of the side wall 92 so as to define a guide slot which accommodates therein an upper edge of the original box structure end panel 18, as described hereinafter. As also illustrated in FIG. 8, a further short flange 99A, which is aligned with the flange 99, projects outwardly from the exterior side surface of the main side wall 92 at a location directly adjacent the rear edge thereof. This flange 99A also has a small tab 101A cantilevered downwardly therefrom and effectively defining an extension of the slot defined by the tabs 101. The rear flange 99A also has a rear tab or stop flange 103 formed thereon, the latter being disposed directly adjacent the rear of the end panel 91 and projecting transversely, i.e. perpendicularly outwardly generally in alignment with the slot designed by the tabs 101 and 101A so as to overlap a rear edge of the original box structure end wall 18 when the latter is engaged with the respective end panel 91.

The end panel 91 also mounts thereon a large tab 102 which is offset outwardly from the exterior surface of the side wall 92 and is cantilevered downwardly through a significant extent, whereby the region under the tab 102 is also aligned with the slot defined by the tabs 101, 101A. The large tab 102 functions as a spring-type securing clip for engagement with an upper portion of the original box structure end wall 18. The tabs 101, 101A and 102, adjacent the lower free ends thereof, each have a horizontally elongate rib extending therealong and protruding inwardly so as to create a resilient snaplike engagement with the flanged upper edge of the end wall 18 when the upper edge thereof is fitted into the slot defined by the tabs.

Figure 19:
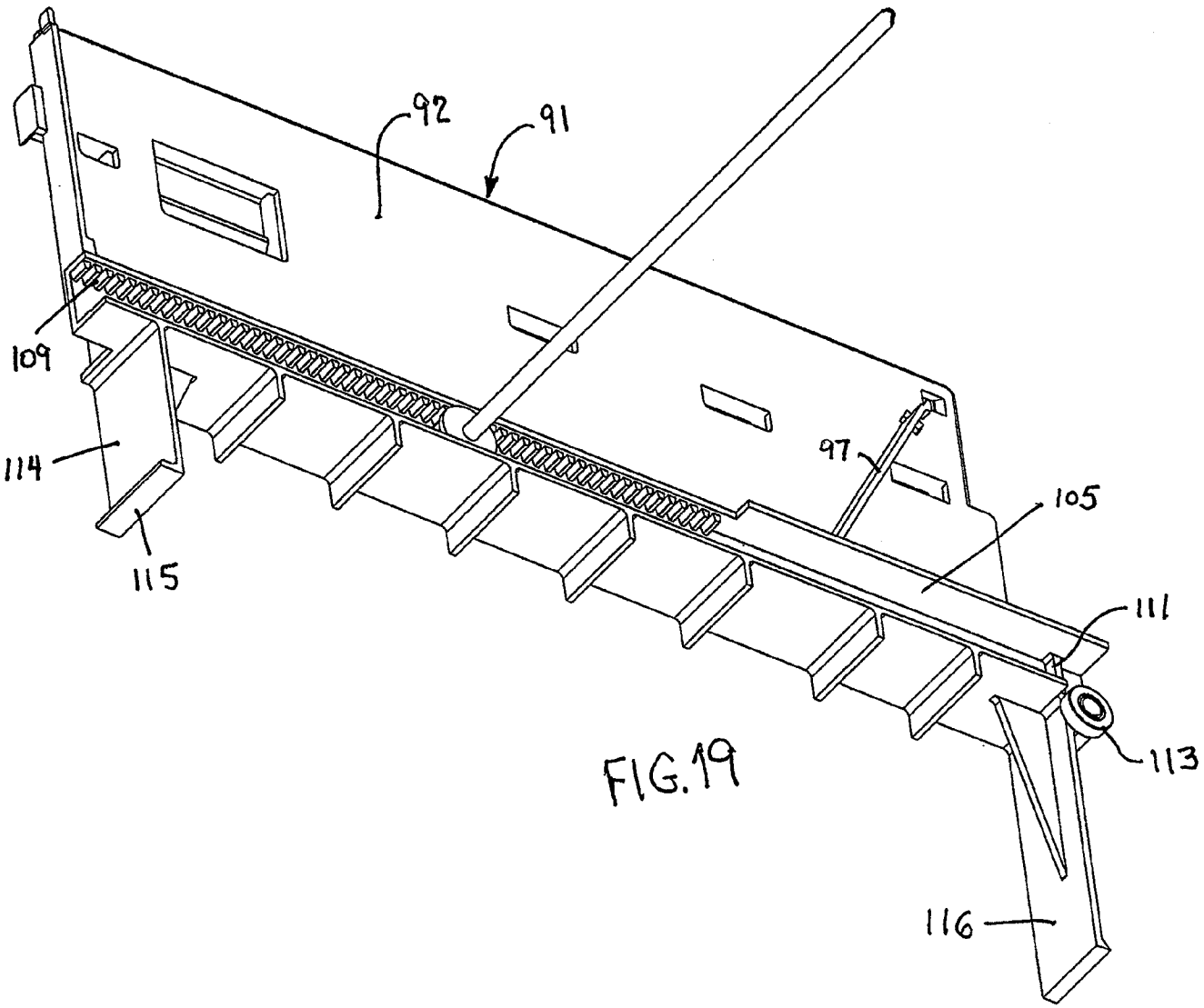
FIG. 19 is a perspective view which illustrates the inner side of the outer end panel, as associated with the upper insert drawer, and the gear rack thereon and its cooperation with an anti-racking gear as carried on the lower insert drawer arrangement.

The end panel 91, adjacent the lower horizontally extending edge thereof, is provided with a horizontally elongate channel structure 104 (FIGS. 9, 18 and 20) which extends lengthwise between the front and rear edges of the end panel 91. This channel structure 104 has a horizontally elongate top wall 105 which joins to and projects horizontally inwardly from a lower edge of the side wall 92, whereby the top wall 105 is spaced downwardly a small distance below the base flange 94, thereby defining a narrow clearance slot 106 therebetween which extends horizontally in the front-two-back direction. The top wall 105 in turn joins to a horizontally extending rear wall 107, the latter projecting vertically downwardly. The wall 107 is generally parallel with but spaced inwardly a small distance relative to the main side wall 92. Rear wall 107 at its lower edge joins to a bottom wall 108 which is cantilevered inwardly in generally parallel relationship to the top wall 105. The top wall 105, on the underside thereof, has a gear rack 109 formed thereon, which gear rack extends from a rearward free end of the wall 105 horizontally forwardly until terminating at a location spaced rearwardly from the front edge of the end panel 91. This gear rack 109 extends forwardly from the rear edge of the end panel 91 over a distance of at least approximately two-thirds of the distance toward the front edge thereof as illustrated in FIG. 19. In addition, the end panel 91 mounts a stop member 111 thereon, the latter being disposed generally within the channel 104 in close proximity to the front edge of the end panel 91.

Each outer end panel 91 also mounts thereon, in close proximity to a forward end of the elongate channel 104, a support hub 112 (FIG. 17) defining a bore therethrough which is oriented horizontally in generally perpendicular relationship to the main side wall 92. The hub 112 and its associated bore are disposed generally adjacent and just below the lower wall 108 of the channel 104, and substantially at the front end thereof. This hub 112 supports therein an axle of a guide roller 113 (FIGS. 17 and 19) which is rotatably supported directly at the forward edge of the end panel 91, with the roller 113 being supported for rotation about a generally horizontal axis which is perpendicular to the plane of the main side wall 92. The support roller 113 is elevationally positioned such that the upper peripheral surface thereof is generally at and preferably slightly above the bottom wall 108 of the channel 104. This roller 113 hence is positioned so that the upper peripheral surface thereof is disposed in rolling engagement with the under surface of the bottom rail 45 provided on the adjacent inner end panel 34 when the top and bottom drawer assemblies are assembled together, as discussed hereinafter.

Each of the outer end panels 91 has a short rear leg 114 (FIG. 19) which is fixedly joined to and cantilevered vertically downwardly from the bottom wall 108 of the channel member 104. This rear leg 114 is disposed closely adjacent the rear edge of the panel member 91 and, at its lower free end, is provided with a bottom flange 115 which protrudes horizontally rearwardly. A further long front leg 116 is rigidly joined to and cantilevered downwardly from the bottom wall 108 adjacent the front end thereof. This leg 116 is disposed just rearwardly of the support hub 112 for roller 113. The leg 116 is of longer vertical extent so that a lower end thereof can seat against the bottom wall 17 (FIG. 26) of the original drawer box structure, whereas the rear leg 114 is of lesser length and is configured to project downwardly adjacent the rear wall 19 of the original box structure with the bottom flange 115 on the rear leg 114 being positioned to hook under the shoulder 21 associated with the rear wall 19.

The right and left outer end panels 91 couple to opposite ends of a horizontally-elongate one-piece top drawer member 117 (FIGS. 4-9) which is of a generally upwardly-opening channel-shaped cross section. This top drawer member 117 includes a generally horizontal bottom wall 118 which at a rear edge joins to a generally vertical or upright rear wall 119, and at a front edge joins to a front wall 121 which is inclined forwardly or outwardly as it projects upwardly.

To secure the top drawer member 117 (FIG. 15) to the right and left outer end panels 91, the bottom wall 118 has a plurality of elongate narrow slots 128 formed therethrough adjacent each end edge, and the slots 128 align with and receive therein the positioning ribs 95 associated with the mounting flange 94. When the bottom wall 118 is being seated on the flanges 94, the spring tabs 98 initially deflect outwardly to allow passage of the bottom wall downwardly therepast, and then the spring tabs 98 spring back inwardly so as to closely overly the upper surface of the bottom wall adjacent the end edge thereof, thereby securing the bottom wall 118 to the base flanges 94. In addition, the inclined front wall 121 has an upper-flange or hem 127 extending along the upper edge thereof and, adjacent the end edges of the drawer member, the flange 124 has openings 128 which accommodates therein a projection 122 (FIG. 18) formed on the upper end of the inclined front flange 97 to effect securement with the front wall 121. And similarly, the rear wall 119 has a top flange or hem 124 which has openings 126 therethrough adjacent the end edges, and these openings accommodate therein securing fingers 125 which project upwardly from the rear flanges 95.

Figure 5:
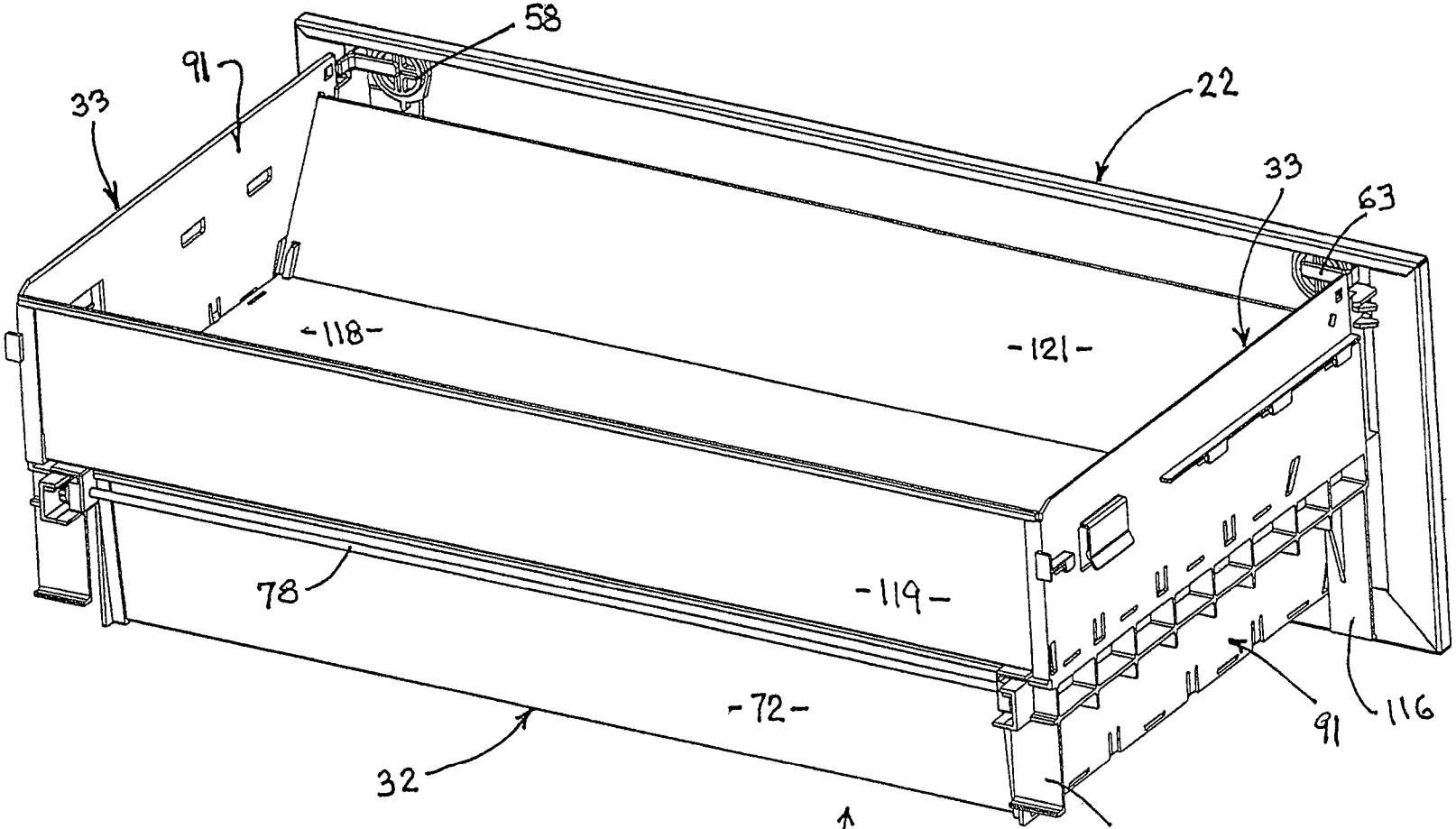
FIG. 5 is a rear perspective view of the assembled insert, the latter being shown with the lower drawer in its non-extended position so that it is disposed generally directly below the upper insert drawer.

Each of the outer side panels 91, in the vicinity of the front upper corner of the inside wall 91, has a detent opening or recess 129 (FIG. 9) formed therein and positioned for engagement with the detent projection 65 associated with the detent lever 62 when the lower drawer assembly 32 is in the non-extended position disposed directly adjacent and under the upper drawer, as illustrated in FIG. 5, so that the detent assists in holding the upper and lower drawers in this non-extended, vertically superimposed relationship.

While the drawer insert assembly 31 of this invention can be assembled to the drawer 16 of a file cabinet at the site of manufacture if desired, it is nevertheless contemplated that the drawer insert assembly 31 will preferably be packaged as a kit so as to facilitate the transport and subsequent assembly of the drawer insert arrangement to an existing file drawer at a position of use. Such kit will include the following: right and left inner end panels 34, right and left outer end panels 91, bottom drawer member 68, top drawer member 117, elongate shaft 78, and two anti-racking gears 79.

The assembly of the drawer insert arrangement 31, and the structural connection or retrofitting thereof to an existing drawer 16 will now be briefly described.

Initially, the drawer front 22 is detached from the remainder of the drawer box, such as by removal of screws which attach the drawer front 22 to flanges provided along the front edges of the drawer box end walls 18, thereby effecting separation of the drawer front 22 as diagrammatically illustrated in FIG. 26.

The right and left inner side panels 34 are then mounted on the drawer front 22 adjacent the opposite upright end edges thereof. Specifically, each end panel 34 is generally vertically oriented and positioned with the front edge thereof adjacent the back side of the door front 22. The end panel 34 is preferably angularly displaced a small angular extent from its vertical orientation so that the front edge of the end panel, namely from the lower leg 48 up through the column 51, can be positioned directly adjacent the back side of the front panel 23, generally between the upper and lower edged channels 29 and 25, respectively. When so positioned, the end panel 34 is manually rotated back into its upright or vertical orientation, which causes the lower leg 48 to be slidably inserted downwardly into the lower edge channel 25 on the drawer front 22, and causes the cam 58 to be inserted upwardly into the upper edge channel 29. In addition, the end panel 34 is slidably displaced sidewardly toward the adjacent end edge of the drawer front 22 so that the side flange 53 on column 51 slides into the edge channel 27, and the rear edge flange 26 of this channel is snuggly inserted into the narrow slot 55 defined between the side flange 53 and the plural horizontal tabs 54. This hence affects proper mounting of the end panel 34 on the drawer front 22, without requiring tools or screws or similar separate fasteners.

The bottom drawer member 68 is then positioned between the sidewardly-spaced end panels 34 and moved downwardly so that the end edges thereof effectively seat on the flange arrangements 37 provided on the inside faces of the end panels 34. During this seating, the ribs 42 on the base flanges 38 project into the elongate slots 73 provided along the edge of the drawer bottom wall 69, and the spring tabs 43 snap inwardly so that lower free ends thereof are positioned directly over the top surface of the bottom wall 69 adjacent the end edges thereof, thereby fixedly securing the bottom drawer member 68 to the right and left end panels 34. During this mounting of the bottom drawer member 68, the small projecting fingers or flanges 79 formed at the upper ends of rear flanges 39 also project upwardly into the openings 76 formed through the top hem 75 of the rear wall 72 so as to effectively fixedly join the rear wall 72, adjacent the upper edge thereof, to the end panels 34. As regards the front wall 71, its upper edge is positioned closely adjacent a back surface of the front panel 23 so that further restraint thereof is not required.

After the bottom drawer member 68 has been assembled to the inner end panels 34 as described above, then the elongate shaft 78 is slidably inserted into and through the aligned bores defined by the support hubs 46 provided adjacent the rear upper corners of the end panels 34. The shaft 78, when properly supportedly engaged with the support hubs 46, is positioned closely adjacent but rearwardly of the upper edge of the rear wall 72, and the ends of the shaft 78 project outwardly a small distance beyond the respective support hubs 46. An anti-racking gear 79 is then slidably inserted coaxially onto each projecting end of the shaft 78, whereby the gears 79 are disposed adjacent the outer surfaces of the end panel 34 in the vicinity of the rear upper corners thereof, substantially as illustrated in FIG. 10. The ends of the shaft 78, and the inner hubs of the anti-racking gears 79, are provided with a conventional configuration, such as a D-shaped configuration, to effect non-rotatable securement of the gears on the shaft.

Figure 20:
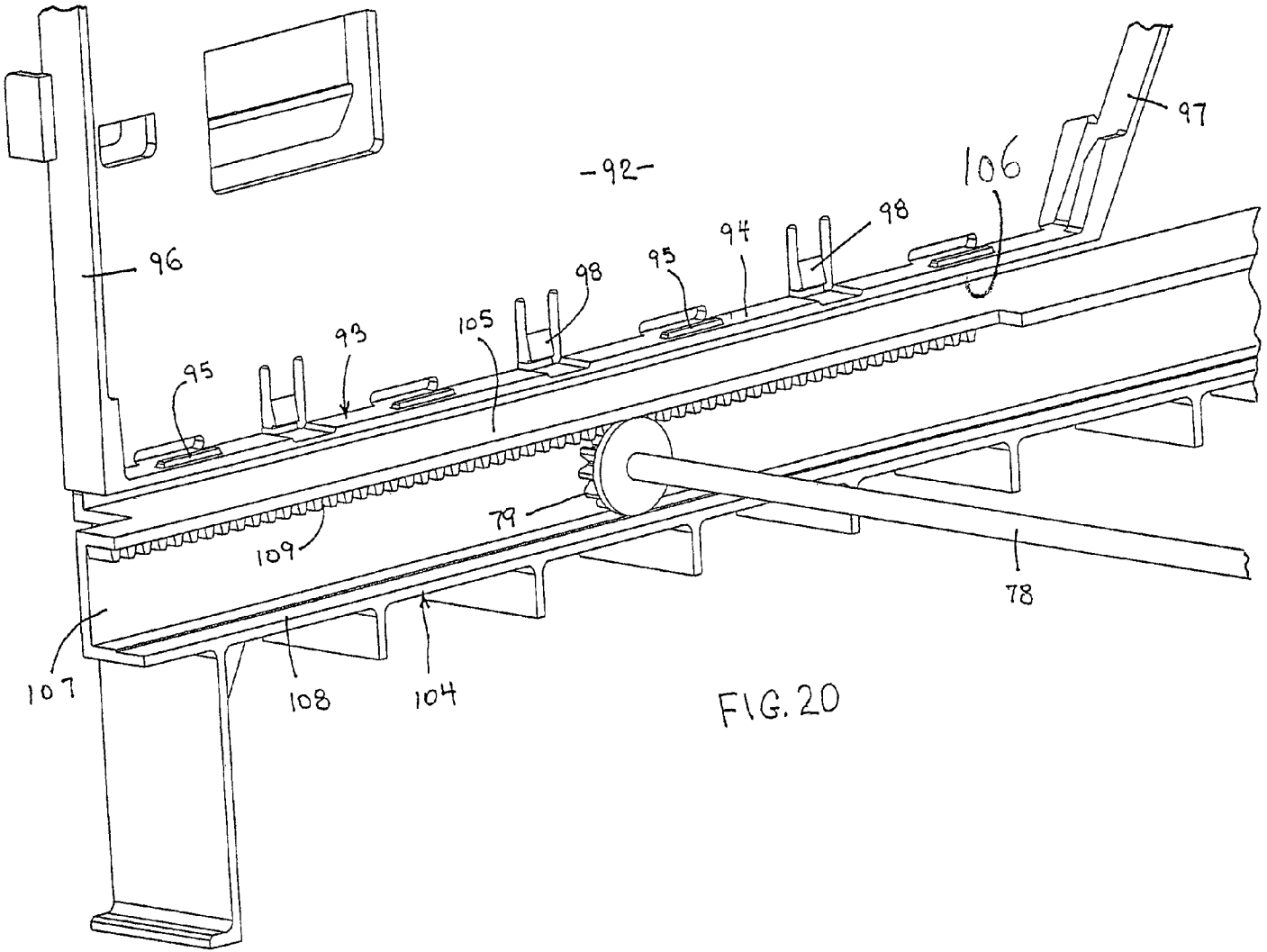
FIG. 20 is an enlarged perspective view which illustrates the gear rack and pinion relationship.
Figure 21:
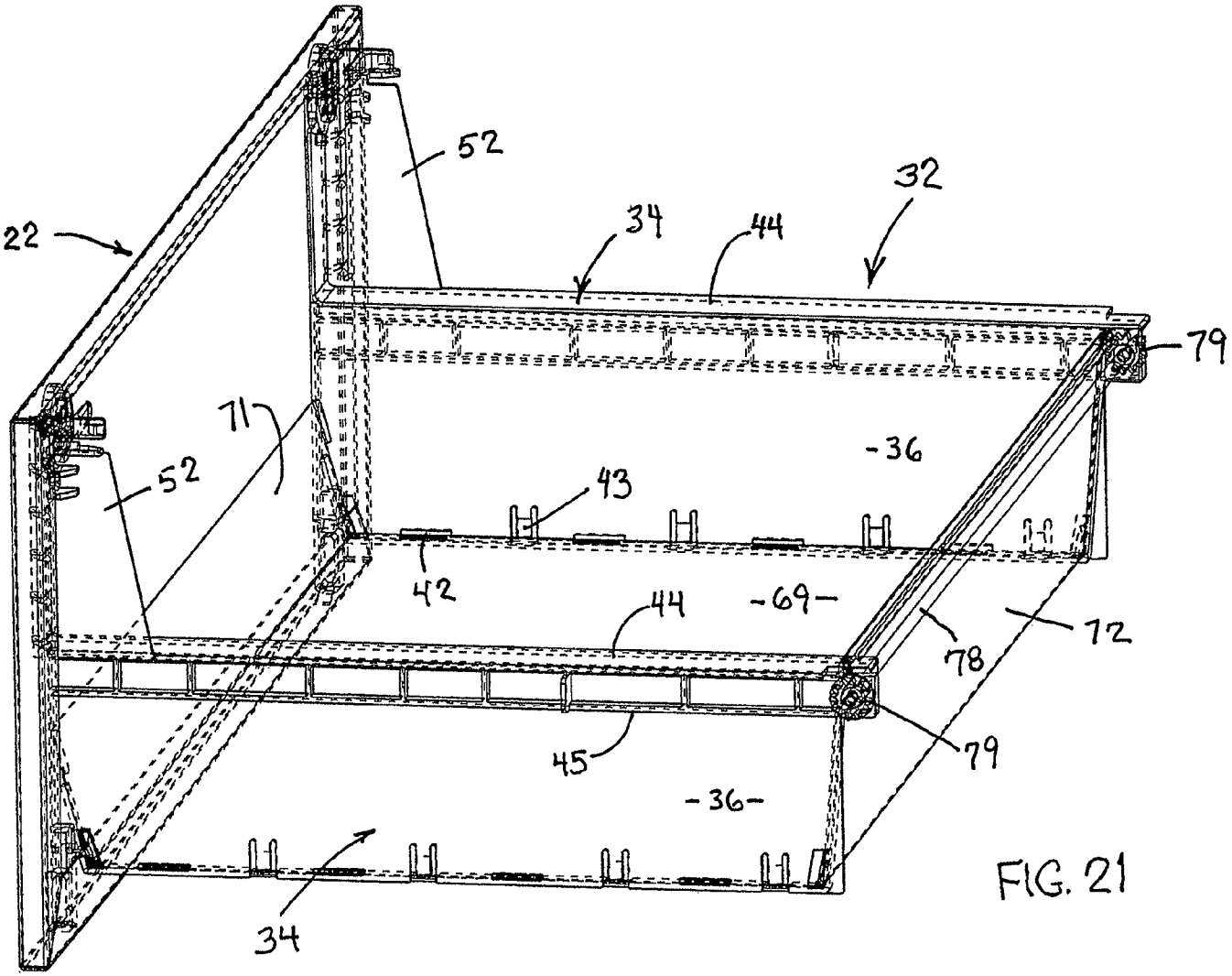
FIG. 21 is a perspective view of the lower insert drawer arrangement and its assembled relationship with the original drawer front.
Figure 22:
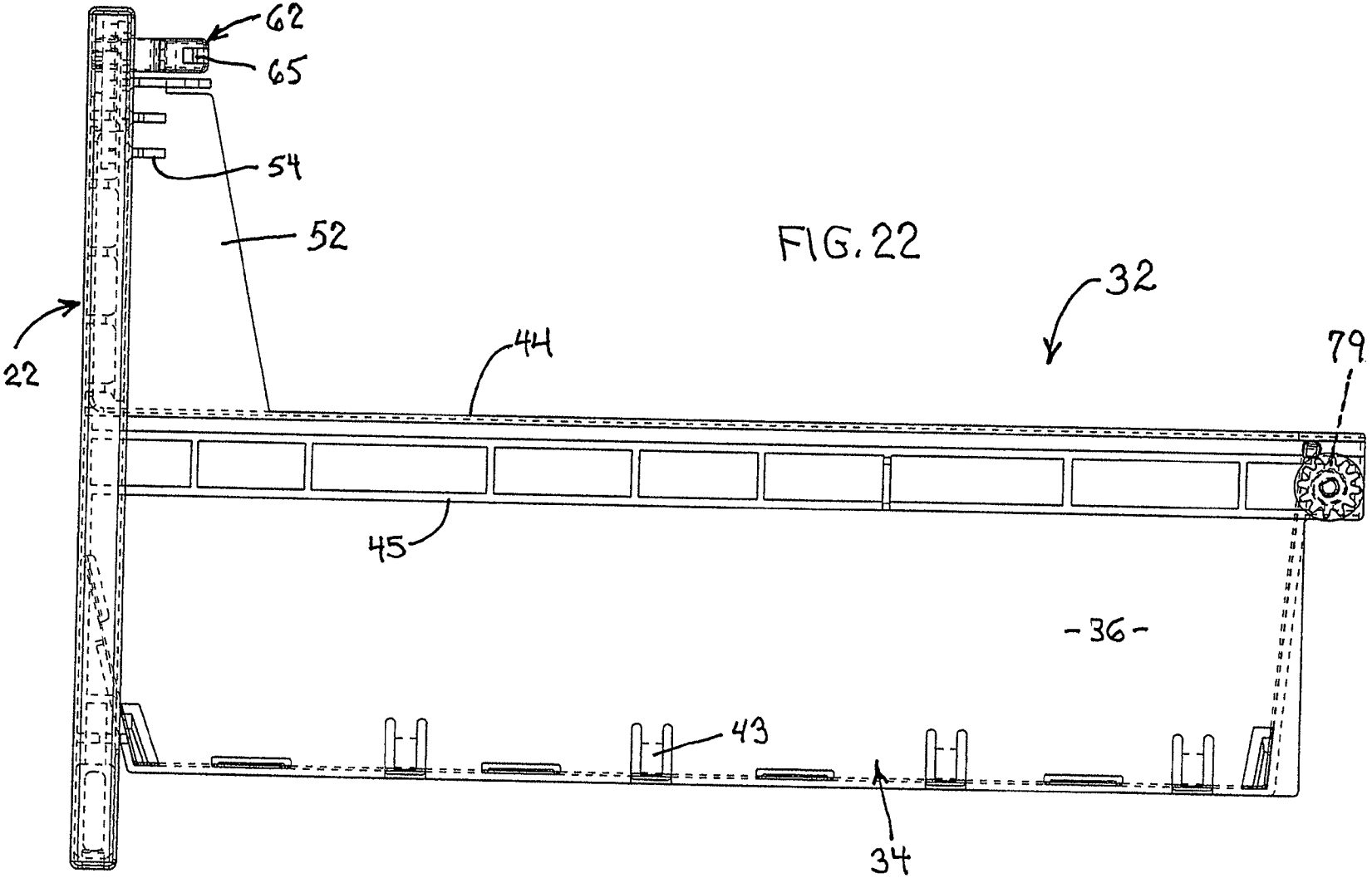
FIG. 22 is a side elevational view of the assembly shown in FIG. 21.
Figure 23:
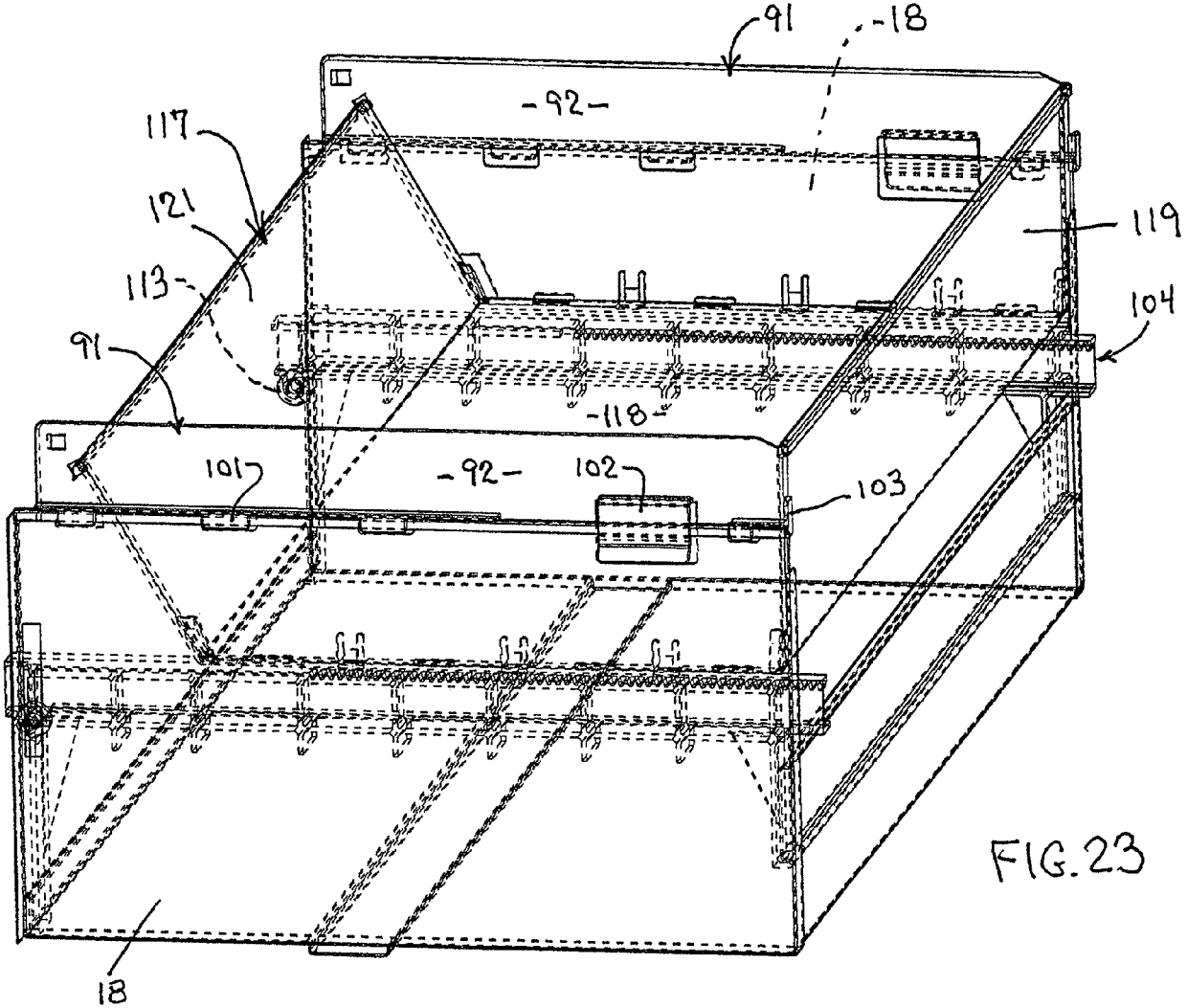
FIG. 23 is a perspective view which illustrates the assembled upper insert drawer arrangement as mounted on the end walls of the original drawer box structure.
Figure 24:
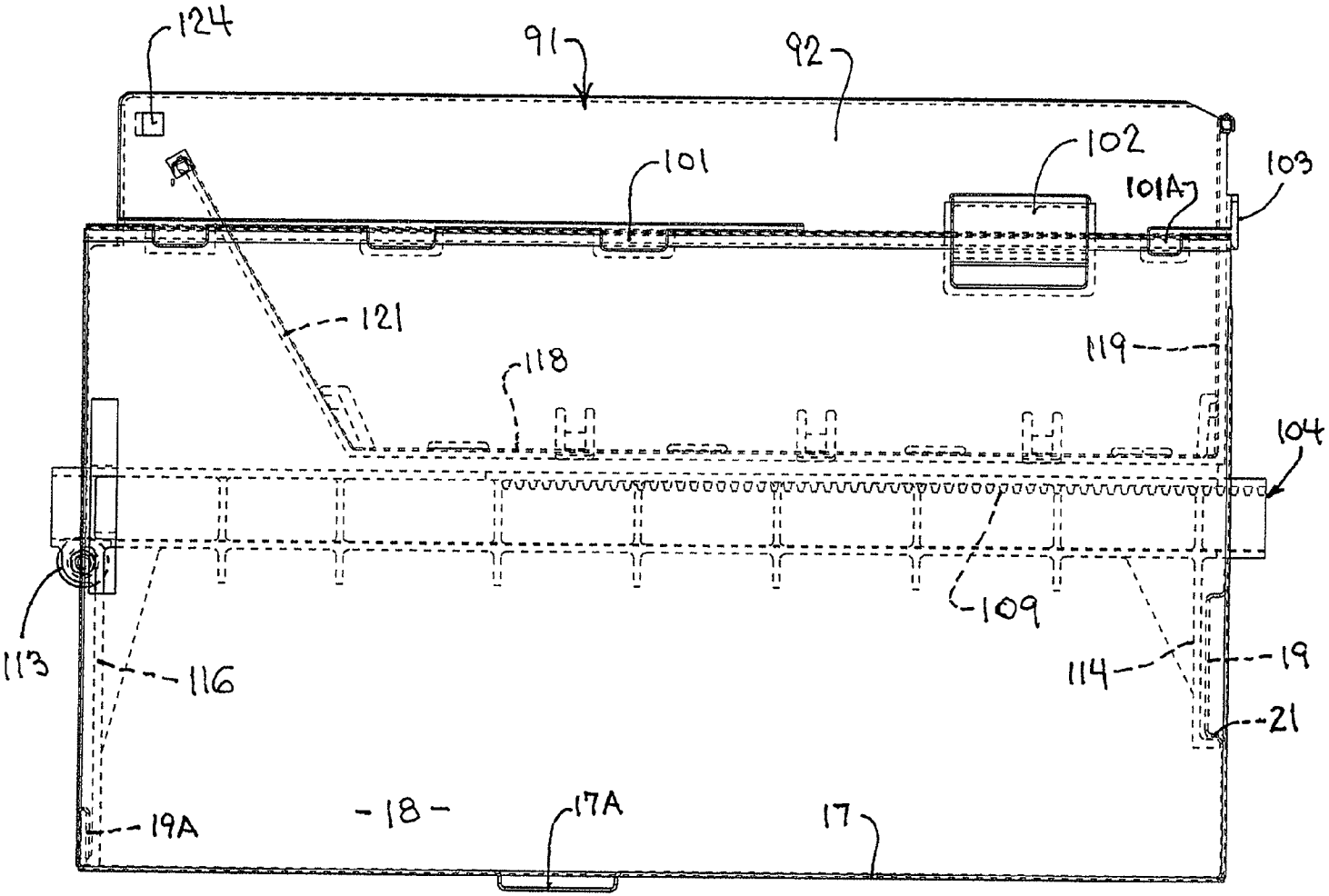
FIG. 24 is an end elevational view of the assembly shown in FIG. 23.
Figure 25:
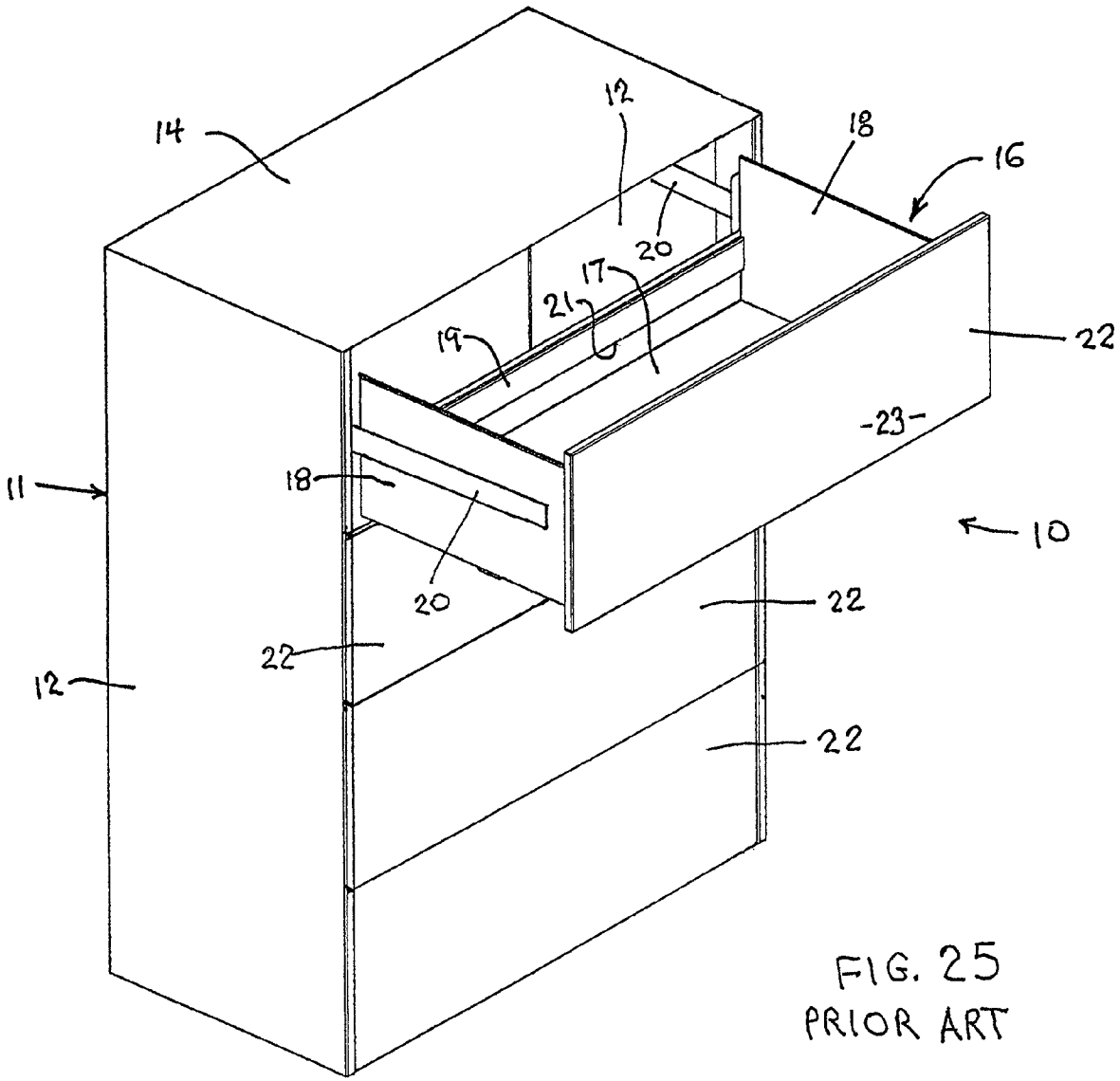
FIG. 25 PRIOR ART
FIG. 25 is a perspective view of a conventional multiple-drawer file cabinet, known has a lateral file, and showing the upper drawer in its fully extended or open position.

As shown in FIG. 20, the gear 79 can be provided with a support roller 81 which is coaxially adjacent and rotatable relative to the gear. The roller 81 is of slightly larger diameter than gear 61 and hence can be disposed in rolling supportive engagement with the lower wall 108 of channel 104 when the gear 79 is in meshing engagement with the gear rack 109.

The outer end panels 91 are now assembled to the inner end panels 34. For this purpose, the right and left end panels 91 are positioned closely adjacent the outer sides of the respective right and left inner end panels 34, whereby the latter end panels 34 are effectively sandwiched between the outer end panels 91. This is preferably accomplished by initially positioning each outer end panel 91 adjacent the respective inner end panel 34 so that the detent 64 associated with the inner panel 34 projects into the detent recess 129 provided adjacent the upper front corner of the respective outer end panel 91, while at the same time maintaining the outer end panel 91 in a slightly outwardly and rearwardly angled relationship relative to the adjacent inner end panel 34. While maintaining the detent 65 within the detent recess 129, the outer end panel 91 is then slowly angularly moved inwardly toward the inner end panel 34, causing the top flange 44 on the end panel 34 to move into the horizontally elongate clearance slot 106 defined between the base flange 95 and the channel top wall 105 on the outer end panel 91. This assists in proper positioning of the adjacent end panels, and allows the end panel 91 to be moved inwardly toward end panel 34 so as to allow the anti-racking gear 79 to move into meshing engagement with the gear rack 109. This also results in the support roller 113 mounted on the adjacently front edge of the end panel 91 to be moved into position directly below the bottom rail or rib 49 provided on the outer side of the main side wall 36 so as to be positioned for supportive rolling engagement with the bottom surface of this rail.

The top drawer member 68 is now assembled to the outer side panels 91, which are maintained in assembled relation to the inner side panels 34. The top drawer member 68 is positioned directly over the lower drawer, and then moved downwardly between the outer end panels 91 so as to seat the drawer member 68 on the seating flange arrangements 93. As the bottom wall 68 seats on the base flanges 94, the ribs 95 project into the slot-like positioning opening 128, and the spring tabs 98 initially deflect out, and then snap back over the top of bottom wall 69 so as to fixedly join the top drawer member 68 to and between the end panels 91. This seating movement also enables the fingers 122 and 125 to engage within the respective openings 128 and 129 associated with the top hems of the respective front and rear walls 121 and 119.

With the upper insert assembly 33 assembled to the bottom insert assembly 32 as described above, and maintained in this assembled relationship, the entire assembled drawer insert 31, and the drawer front 22 which is assembled thereto, is then assembled to the original drawer box end walls 18. For this purpose, the insert assembly 31 is positioned between the sidewardly-spaced end walls 18 so that lowers portions of outer end panels 91 are directly sidewardly adjacent inner side surfaces of the respective original end walls 18. The insert assembly 31 is then manually lowered, preferably at a slight angle so that the rear is tilted downwardly, so that further lowering of the insert assembly causes the rear upper corners of the end walls 18 to slide into the slots defined by the rear rib 99A and associated tab 101A, and effecting seating of the rear edge of the original end wall 18 against the rear stop 103. During this downward tilted movement of the insert assembly 31, this also results in the rear lower legs 114 being moved downwardly into the original box structure adjacent the rear wall 19 thereof. The insert assembly 31 is then further moved by swinging the front portion thereof downwardly so as to cause the upper edges of the original end walls 18 to project upwardly into the securing clip 102 and into the slot defined by the rib 99 and tabs 101, which causes the tabs 101 to initially deflect as they pass over the flanged upper edge of wall 18, and then resiliently snap back below the flanged edge to effect securement to the end wall 18. This positional swinging movement of the insert 31 into full seated engagement with upper edges of the original end walls 18 also results in the front legs 116 being moved downwardly for contacting engagement with the bottom wall 17 of the original box structure in close proximity behind the front flange 19A thereof. In addition, when in this fully seated position, the bottom flanges 115 associated with the rear legs 114 project or snap rearwardly beneath the shoulder 21 formed on the rear wall 19 so as to prevent upward lifting of the rear portion of the insert assembly 31 relative to the original box structure of the drawer.

Once the drawer insert arrangement 31 has been assembled and structurally connected between the drawer front 22 and the remainder of the original box structure of the drawer 16, a final adjustment with respect to the position of the drawer front 22 can be carried out so as to achieve the desired final position thereof, particularly for clearance and appearances purposes when the drawer front is in the closed position. For this purpose, the cams 58 as provided on the upper ends of the columns 51, which cams are engaged within the upper channels 29, can be manually rotated by engaging the radially projecting finger tabs 61, thereby varying the contact point between the upper wall of the channel 29 and the eccentric cam surface 59 formed on the cam 58, thereby allowing slight adjustment at one or both upper corners of the drawer front 22 for achieving the desired positioning thereof.

The entire assembly of the drawer insert arrangement, and specifically its connection to the drawer front and the original drawer box structure, can be manually carried out without requiring any specific tools or other complex installation and assembly equipment, other than use of a screw driver to effect removal of the screws which initially secure the drawer front 22 to the original end walls 18.

With the drawer insert arrangement assembled to the drawer as described above, the drawer when retrofitted with the insert assembly will in a closed position have the same overall exterior appearance. When use of the drawer is desired, multiple access options are available. First, if one engages and manually pulls the drawer front 22 outwardly into a normal open position as illustrated in FIG. 1, the detent lever 62 will initially hold the top and bottom insert drawers in superimposed relationship one above the other, whereupon the outward pulling force is transmitted to the outer side panels 91 which, due to their fixed mounting on the original end walls 18, effects movement of the latter horizontally outwardly along the telescopic ball side units 20 into the open position illustrated by FIG. 1. In this latter position, only the interior of the top insert drawer 117 is visible and vertically accessible.

If one also desires to simultaneous access the bottom insert drawer 68, then continued outward pulling force applied to the drawer front 22 effects release of the detent levers 62 so that the drawer front 22 and the inner end panels 34 mounted thereon are pulled horizontally outwardly into a telescopically extended open position illustrated by FIG. 2, in which position the bottom insert drawer subassembly 32 is now located outwardly from beneath the top insert drawer assembly and hence is vertically visible and accessible. During this outward extension of the bottom insert drawer arrangement 32, the anti-racking gears 79 disposed adjacent rear upper corners of the side panels 34 roll in meshing engagement along the fixed gear racks 109 provided on the stationary outer end panels 91, thereby preventing sideward twisting or racking of the bottom insert drawer as it moves between its telescopically extended and contracted positions. In addition, the rollers 113 provided adjacent a front edge of the end panels 91 are disposed in supportive rolling engagement with the bottom surfaces of the horizontally elongate guide rails 45 provided on the exterior sides of the adjacent inner end panels 34, and the rollers 81 roll along the bottom rail 108 of channel 104 defined on inner end panel so as to assist in providing the support necessary to permit the outward cantilevered extension of the bottom insert drawer subassembly 32.

The horizontal outward extension of the bottom insert drawer assembly 32 from the closed position wherein in the bottom drawer is effectively stored and closed off directly under the upper insert drawer, into the open extended position as illustrated by FIG. 2, is limited by stops associated with the cooperating adjacent end panels 34 and 91. Specifically, as the inner end panels 34 and the lower insert drawer are extended outwardly into the open position, the stop tabs 47 provided on the inner end panels 34 move outwardly until contacting the stop members 111 provided adjacent the forward end of channels 104 on the outer end panels 91, thus limiting the outward opening extension of the bottom insert drawer. This opening outward extension, in a preferred embodiment, is at least a minimum of about fifty percent (50%) of the front-two-back depth of the drawers, and as illustrated is more preferably in the neighborhood of approximately two-thirds (⅔) of the front-two-back drawer width so as to provide convenient access to substantially the entirety of the upward-opening lower storage compartment.

Although a particular preferred embodiment of the invention has been disclosed in detail for illustrative purposes, it will be recognized that variations or modifications of the disclosed apparatus, including the rearrangement of parts, lie within the scope of the present invention.

The invention claimed is:

1. A storage drawer structure, comprising:

a file cabinet comprising a housing having parallel upright side walls joined by an upright rear wall and having a drawer opening formed in a an upright front side thereof, and an upwardly opening box-shaped drawer horizontally movably supported on said housing and movable between a closed position disposed within the housing and an open position wherein the drawer is cantilevered horizontally outwardly from said front side to permit vertical access into said drawer;

said drawer comprising a partial box structure which is horizontally moveable over a range between said open and said closed position and supported on the housing and includes a horizontal bottom wall extending between and rigidly joined to a pair of sidewardly spaced and parallel end walls which protrude upwardly and are rigidly joined by an upright rear wall disposed adjacent a rear edge of said bottom wall;

a vertical panel door front cooperating with said partial box structure, when the drawer is in said closed position, for closing off the drawer opening in said front side, said door front being free of direct structural joinder to said partial box structure;

a multi-drawer insert arrangement structurally coupled between said drawer front and said partial box structure; said multi-drawer insert arrangement including a first insert assembly having an upwardly-opening top drawer, the top drawer having parallel top drawer end panels with a horizontal bottom therebetween, said first insert assembly being fixedly mounted on said partial box structure with said top drawer being disposed in upwardly spaced relationship directly above said bottom wall and extending between said upright end walls, said top drawer end panels being fixedly mounted to respective said end walls of said partial box structure;

said multi-drawer insert arrangement also including a second insert assembly having an upwardly-opening bottom drawer, said bottom drawer having parallel bottom drawer end panels with a horizontal bottom there between, said second insert assembly being fixedly mounted on said drawer front and cantilevered horizontally rearwardly therefrom;

said second insert assembly being horizontally movably supported on said first insert assembly for movement with respect to said drawer and said first insert assembly between a contracted position wherein the bottom drawer is disposed vertically directly under said top drawer and an extended position wherein the bottom drawer is cantilevered horizontally outwardly from a front edge of said top drawer so as to permit access to said bottom drawer; and wherein said upwardly-opening bottom drawer of the second insert assembly extends beyond said horizontal range of movement of said drawer when said second insert assembly is cantilevered horizontally outwardly from said edge of said top drawer and said drawer is in said open position.

2. A drawer structure according to claim 1, wherein said second insert bottom drawer end panels are mounted to a rearward side of said door front adjacent opposite ends thereof, said end panels being cantilevered horizontally rearwardly from said drawer front in parallel relation, and said bottom drawer horizontal bottom being positioned adjacent a rear side of said drawer front and between said bottom drawer end panels and fixedly supported thereon.

3. A drawer according to claim 2, wherein said first insert assembly top drawer end panels are positioned sidewardly adjacent to respective said end walls of said partial box structure.

4. A drawer structure according to claim 3, wherein said bottom drawer end panels are positioned sidewardly adjacent but inwardly adjacent said top drawer end panels so that the second insert assembly is sandwiched between the top drawer end panels.

5. A drawer structure according to claim 4, wherein said bottom drawer end panels, and respectively adjacent said top drawer end panels have guide structure cooperating therebetween for permitting horizontal displacement of said second insert assembly and the bottom drawer carried thereon between said extended and contracted positions.

6. A drawer structure according to claim 5, wherein said guide structure includes a first roller member rotatably mounted on each said top drawer end panel adjacent a first edge thereof and positioned in rolling engagement with a horizontally elongate guide rail provided on the respectively adjacent bottom drawer end panel, and a second roller member rotatably mounted on each said bottom drawer end panel adjacent a rear edge thereof and rollingly engaged with an associated horizontally elongate guide respectively adjacent said top drawer end panel.

7. A drawer structure according to claim 6, wherein said second roller member is a gear, and the associated elongate guide is a gear rack disposed in meshing engagement with said gear.

8. A drawer structure according to claim 4, including a releasable detent structure cooperating between each said top drawer end panel and the respectively adjacent said bottom drawer end panel for releasably holding said second insert assembly in said contracted position.

9. A drawer according to claim 1, wherein said first insert assembly top drawer end panels are positioned sidewardly adjacent to respective said end walls of said partial box structure.

10. A drawer structure according to claim 1, including a releasable detent structure cooperating between each said top drawer end panel and the respectively adjacent said bottom drawer end panel for releasably holding said second insert assembly in said contracted position.

11. A storage drawer structure, comprising:

a file cabinet comprising a housing having parallel upright side walls joined by an upright rear wall and having a drawer opening formed in an upright front side thereof, and an upwardly opening box-shaped drawer horizontally movably supported on said housing and movable between a closed position disposed within the housing and an open position wherein the drawer is cantilevered horizontally outwardly from said front side to permit vertical access into said drawer;

said drawer comprising a partial box structure which is horizontally supported on the housing and includes a horizontal partial box structure bottom wall extending between and rigidly joined to a pair of sidewardly spaced and parallel end walls which protrude upwardly and are rigidly joined by an upright rear wall disposed adjacent a rear edge of said bottom wall; a vertical panel door front cooperating with said partial box structure, when the drawer is in said closed position, for closing off the door opening in said front side, said door front being free of direct structural joinder to said partial box structure;

a drawer insert arrangement structurally coupled between said drawer front and said partial box structure;

said drawer insert arrangement including a top drawer having a top drawer bottom wall, the top drawer having a support assembly fixedly mounted on said end walls of said partial box structure above said partial box structure bottom wall, said top drawer fixed to and movable with said partial box structure, said top drawer bottom wall being fixedly mounted to said support assembly;

said drawer insert arrangement also including a drawer assembly having an upwardly-opening lower insert drawer positioned between the bottom wall of the partial box structure and the horizontal bottom wall of the fixed top drawer, said drawer assembly being fixedly mounted on said drawer front and cantilevered horizontally rearwardly; and said lower insert drawer being horizontally movably supported on said support assembly for movement with respect to said top drawer and said fixedly mounted support assembly and said partial box structure between a contracted position wherein said lower insert drawer is disposed vertically directly above said horizontal partial box structure bottom wall and vertically directly below said top drawer bottom wall and an extended position wherein said drawer front is cantilevered horizontally outwardly from a front edge of said partial box structure so as to permit access to said lower insert drawer.

12. A drawer structure according to claim 11, wherein said drawer assembly includes a pair of upright and parallel end panels which adjacent forward ends thereof are mounted to a rearward side of said door front adjacent opposite ends thereof, said end panels being cantilevered horizontally rearwardly from said drawer front in parallel relation, and said insert drawer being positioned adjacent a rear side of said drawer front and between said end panels and fixedly supported thereon.

13. A drawer structure according to claim 12, wherein said support assembly includes a pair of upright and parallel support panels fixedly mounted to the respective end walls of said partial box structure, and wherein said end panels are positioned sidewardly adjacent but inwardly adjacent said support panels so that the drawer assembly is sandwiched between the support panels.

14. A drawer structure according to claim 13, wherein respectively adjacent said end and said support panels have guide structure cooperating therebetween for permitting horizontal displacement of said drawer assembly and the insert drawer carried thereon between said extended and contracted positions.

15. A drawer structure according to claim 14, wherein said guide structure includes a roller member rotatably mounted between surfaces of each pair of said support and said end panels, and positioned in rolling engagement with a horizontally elongate guide rail.

16. A drawer structure according to claim 15, wherein said roller member is a gear, and the associated elongate guide is a gear rack disposed in meshing engagement with said gear.

17. A drawer structure according to claim 11, wherein said support assembly includes a pair of upright and parallel support panels, said support panels being positioned sidewardly adjacent and fixedly mounted to the respective end walls of said partial box structure.

18. A process for retrofitting a multi-drawer insert to a drawer of a file cabinet, comprising the steps of:

providing an upright file cabinet defined by a housing having at least one upward opening box-shaped drawer which is movably supported on the housing for movement between (1) a closed position wherein the drawer is positioned within the housing so that a front associated with the drawer effectively closes an opening defined in a front side of said housing and (2) an open position wherein the drawer is cantilevered horizontally outwardly from said front side to permit vertical access to the interior of said drawer;

providing said drawer with a partial box structure defined by a horizontal bottom wall joined at opposite ends to a pair of upright end walls which are joined by a rear wall disposed adjacent a rear edge of said bottom wall, said drawer front being initially fixedly attached to said partial box structure to define a front wall thereof;

detaching said drawer front from said partial box structure so that said drawer front is in a detached state wherein it is wholly free of structural connection to the drawer front or the housing;

providing a multi-drawer insert arrangement including a bottom drawer arrangement and a top drawer arrangement which respectively include upwardly-opening bottom and top drawers;

stationarily attaching said bottom drawer arrangement to a rear side of said drawer front when in its detached state so that the bottom drawer arrangement is cantilevered horizontally rearwardly and the bottom drawer is disposed adjacent a rear side of the drawer front and opens upwardly;

stationarily attaching the top drawer arrangement to said partial box structure so that said top drawer is positioned directly over but vertically spaced upwardly a distance above said bottom wall and opens upwardly;

positionally supporting said bottom drawer arrangement on said top drawer arrangement so that said bottom drawer arrangement and the door front coupled thereto are carried entirely by said top drawer arrangement and are horizontally movable relative to said top drawer arrangement and said partial box structure between a nonextended storage position wherein the bottom drawer is positioned directly under said top drawer and an extended access position wherein the bottom drawer is horizontally cantilevered outwardly beyond a front side of said top drawer and said partial box structure to permit vertical access to said bottom drawer; and wherein said top drawer assembly includes a pair of upright support panels and an upwardly-opening channel-shaped top drawer member; positioning the support panels in sidewardly-spaced but parallel relationship, and positioning said top drawer member between said sidewardly-spaced support panels, and then fixedly securing opposite ends of the top drawer member to the respective support panels; and positioning said support panels adjacent respective ones of said end walls and fixedly mounting said support panels thereon to fixedly attach said top drawer assembly to said partial box structure.

19. A process according to claim 18, wherein said bottom drawer arrangement includes a pair of upright end panels and an upwardly-opening channel-shaped bottom drawer member; initially individually attaching each end panel to the rear side of said door front adjacent a respective upright end edge thereof; then positioning said bottom drawer member adjacent the rear side of said drawer front and extending between said end panels, and fixedly securing opposite ends of the bottom drawer member to the respective end panels.

20. A process according to claim 19, including the steps of: initially individually positioning said support panels outwardly but directly sidewardly adjacent respective ones of said end panels and effecting engagement therebetween, and then securing the support panels to the respective end walls of said box structure.

21. A process according to claim 20, wherein connection of said end panels to the drawer front, and connection of the support panels to said end walls, are both free of detachable fasteners.

22. A process according to claim 20, including the step of mounting a first rolling member on each said support panel adjacent a forward end thereof, and mounting a second rolling member on each said end panel adjacent a rearward end thereof, and positioning said rolling members in supportive rolling engagement with opposed supportive guide surfaces formed on the respectively adjacent said end panels and said support panels to provide supportive engagement for the bottom drawer arrangement when the bottom drawer is moved into its extended position.

* * * * *